United States Patent [19]

Husseiny

[11] Patent Number: 5,055,237

[45] Date of Patent: Oct. 8, 1991

[54] METHOD OF COMPACTING LOW-LEVEL RADIOACTIVE WASTE UTILIZING FREEZING AND ELECTRODIALYZING CONCENTRATION PROCESSES

[75] Inventor: Abdo A. Husseiny, LaPlace, La.

[73] Assignee: Technology International Incorporated, LaPlace, La.

[21] Appl. No.: 566,880

[22] Filed: Aug. 14, 1990

[51] Int. Cl.[5] ..... G21F 9/08

[52] U.S. Cl. ..... 252/631; 252/626; 252/633; 204/1.5; 204/182.5; 210/682; 210/640; 210/642; 210/651; 23/295 R

[58] Field of Search ..... 252/627, 628, 629, 631, 252/633; 204/1.5, 182.5; 210/640, 642, 651, 682; 260/707; 23/295 R

[56] References Cited

U.S. PATENT DOCUMENTS

| | | | |
|---|---|---|---|
| 3,293,151 | 12/1966 | Holzer et al. | 252/631 |
| 3,305,320 | 2/1967 | Weech | 252/631 |
| 3,361,649 | 1/1968 | Karter | 252/631 |
| 3,405,050 | 10/1968 | Bovard et al. | 422/159 |
| 3,520,805 | 7/1970 | Ryan | 252/633 |
| 3,678,696 | 7/1972 | Cheng et al. . | |
| 3,716,490 | 2/1973 | Van de Voorde | 252/631 |
| 3,966,708 | 6/1976 | Casebier et al. | 71/23 |
| 4,036,749 | 7/1977 | Anderson | 204/186 |
| 4,188,291 | 2/1980 | Anderson | 204/182.5 |
| 4,218,312 | 8/1980 | Perry | 55/16 |
| 4,274,976 | 7/1981 | Kingwood . | |
| 4,311,594 | 1/1982 | Perry | 210/640 |
| 4,392,959 | 7/1983 | Coillet | 210/651 |
| 4,657,747 | 4/1987 | Swansiger | 423/249 |
| 4,759,878 | 7/1988 | Henrich et al. | 252/627 |

*Primary Examiner*—Brooks H. Hunt
*Assistant Examiner*—Ngoclan Mai
*Attorney, Agent, or Firm*—Sixbey, Friedman, Leedom & Ferguson

[57] ABSTRACT

A volume reduction process comprises combinations of a freezing eutectic, bulk, indirect crystallization process and a radwaste electrodialysis process. When employed as a liquid radioactive waste management system (LWMS) for light water reactors (LWR's), this process is designed to process liquid low-level radioactive waste (LLW) and to handle the radioactive influent in nuclear power plants (NPPs) prior to release to the environment and disposal of the radioactive material present in the waste streams.

19 Claims, 8 Drawing Sheets

METHOD OF COMPACTING LOW-LEVEL RADIOACTIVE WASTE UTILIZING FREEZING AND ELECTRODIALYZING CONCENTRATION PROCESSES

This application is a Continuation of Ser. No. 07/411,217, filed Sept. 22, 1989 now abandoned which is a continuation of Ser. No. 07/116,759 filed Nov. 4, 1987 now abandoned.

BACKGROUND OF THE INVENTION

1. Field of the Invention

The present invention relates to radioactive waste management systems, and in particular to a process employing freezing an electrodialysis for concentration of liquid waste streams.

2. The Prior Art

The U.S. Pat. No. 3,271,163 to Malick discloses a combination process for the removal of radioactive material (strontium 90) from milk employing fractional crystallization and ion exchange media but does not disclose the use of ion exchange membranes or electrodialysis.

The U.S. Pat. No. 3,305,320 to Weech discloses a method of purifying aluminum nitrate employing an alternate melting and crystallization process. It also mentions the invention's applicability to eutectic systems, solid-solution systems and the separation of fission products such as impurities from atomic reactor wastes. The Van de Voorde patent discloses as prior art a chemical coprecipitation method of treating radioactive materials additionally employing filtration of the precipitate dehydrated by "the freeze-thaw method".

The U.S. Pat. No. 3,405,050 to Bovard, et al. discloses the use of electrodialysis and precipitation as prior art in the decontamination of radioactive wastes. The Bovard, et al. invention itself is directed toward radioactive decontamination of wastes by way of a filter employing ion exchange materials and electrolysis. A further reference may be found in the McGraw-Hill Encyclopedia of Science and Technology (5th ed. 1982) which briefly discusses the role of ion exchange resin membranes in dialysis and the utilization of micro- and semimicroelectrodialyzers in radioisotope tracer studies. The Shiroki patent, U.S. Pat. No. 4,483,754 discloses and claims a process of electrolysis of NaCl employing ion exchange membranes but does not, however, mention its use in radioactive waste treatment.

The Carlin, et al. and Van de Voorde patents, U.S. Pat. Nos. 3,922,231 and 3,716,490, respectively, disclose methods for decontaminating radioactive liquids by adsorption of the radioactive materials onto ion exchange material but make no specific mention of ion exchange membranes or dialysis. The L. F. Ryan patent, U.S. Pat. No. 3,520,805, achieves a reduction in volume of liquid radioactive waste by filtration through a finely divided ion exchange resin.

SUMMARY OF THE INVENTION

FREDCON is a process employing freezing (FR) and electrodialysis (ED) for concentration (CON) of liquid waste streams. FREDCON is designed to surpass present processes in overcoming limitations on volume reduction (VR) of contaminants and/or dissolved solids in the waste influent. A high VR would alleviate costs incured in disposal of concentrated contaminants and result into high recovery of pure water for reuse or for safe release to the environment.

The FREDCON process comprises combinations of a freezing eutectic, bulk, indirect crystallization (FEUBIC) process and a radwaste electrodialysis (RADWED) process. When employed as a liquid radioactive waste management system (LWMS) for light water reactors (LWR's) FREDCON is designed to process liquid low-level radioactive waste (LLW) and to handle the radioactive influent in nuclear power plants (LLW)(NPPs) prior to release to the environment and disposal of the radioactive material present in the waste streams.

The principal design objectives of the overall FREDCON process in its applications to commercial LWRS used in NPPs are:

1. To protect NPP personnel, the general public, and the environment by ensuring that all releases of radioactive materials, both in the NPP and to the environment, are "As Low As Achievable" (ALARA) and within the limits of the Code of Federal Regulations (CFR), namely 10 C.F.R. 20 and Appendix I to 10 C.F.R. 50.
2. Reduction of the volume of concentrated streams to an extent that allows for economical ultimate disposal.

FREDCON is intended to replace current LWMSs which utilize ion exchangers, filters, and evaporators.

FREDCON processes radwaste streams from NPP's to precipitate dissolved radioactive materials and to provide a concentrated stream of organic as well as inorganic contaminants. The parametric design of the FREDCON process is dependent on the radioactive content of the radwaste water. In certain situations, RADWED may be used as a pre-processing stage. In other radwaste streams, RADWED is more suitable for further concentration of brines produced by FEUBIC. In case of high purity wastes, RADWED may become satisfactory by itself if combined with filters or settling tanks.

FEUBIC comprises an indirect bulk freezing process driven to the eutectic freezing range. In "indirect freezing processes" crystallization is achieved by removal of heat from an LLW feed stream through heat transfer surfaces as opposed to direct contact with a refrigerant which could be water or secondary refrigerant.

In bulk freezing, an LLW feed stream is introduced into the system through a plate precooler where it is chilled to near the freezing point by the exiting brine. The feed is then introduced into the tube side of a shell and tube evaporator. On the shell side ammonia is evaporated, thus removing heat through the tube wall, freezing a portion of the feed. A recirculation loop is employed around the crystallizer to maintain proper velocity and uniformity of ice fraction in the tubes. The ice fraction is also controlled by introducing brine from a wash column into this loop to ensure proper heat transfer, minimum wall subcooling, and sufficient seed crystals.

A flow equal to the feed and recirculation flow is extracted from the crystallizer loop and directed to a gravity wash column which is a cylinder with brine tubes and a rotating cutter. The column is exposed to atmospheric pressure at the top. Ice is consolidated and propelled to the top by hydraulic piston action. Regulated flow of pure water enters over the top surface of the ice to wash away adhering brine.

A controlled portion of the unprocessed feed or brine is extracted from the drainage tubes and pumped out of the wash column through a feed precooler and then partially circulated to the crystallizer. Ice is harvested from the top of the wash column and slurried in a repulp tank with melted ice. The slurried ice is circulated through the melter, which is a shell and tube condenser. The ice slurry flows through the tubes and the refrigerant condenses on the shell side to indirectly melt the ice.

Purified water is extracted from the repulp tank. The refrigerant from the evaporator is compressed and delivered to the melter at a saturation temperature sufficient to allow condensation on the shell side of the melter tubes.

A portion of the compressed vapor, equal to the internal heat load, is compressed slightly above ambient feed saturation temperature and condensed in a shell and tube condenser by water from the feed source.

To dislodge incipient ice buildup on the walls of the crystallizer tubes, a valving arrangement is provided in order to allow hot gas from the compressor discharge to be sequentially introduced to the tube side of th various sections of the crystallizer. The hot gas condenses on and warms the surface of the tubes thus loosening and allowing incipient ice buildup to be scrubbed away by the high velocity brine/ice slurry.

Eutectic freezing refers to th conditions wherein ice and solute crystals are simultaneously formed. The eutectic process involves driving the freezing process at a very high water (aqueous solution) purification rate. The rate of ice formation is increased until the concentration of the residual salts becomes high enough to precipitate some of the salts. The wet salts can be processed for disposal.

Generally, in electrodialysis (ED) processes, positive and negative ions in a solution containing dissolved solids, move towards oppositely charged electrodes immersed in the solution. By alternately placing cationic and anionic membranes between the electrodes, the salts in the solution are concentrated in one stream and depleted in the other. The two streams move counter-currently to each other.

In processing of radioactive waste by RADWED, the fairly high concentration of inactive ions in addition to the traces of radioactive ions, supports a high conductivity in the liquid. Such conductivity is necessary for ED.

Detailed design variables of the FREDCON process are dependent on specific plant designs and on whether the nuclear steam supply system (NSSS) is for a boiling water reactor (BWR) or a pressurized water reactor (PRW). However, the basic elements of FREDCON mostly remain the same in each situation.

DETAILED DESCRIPTION OF THE INVENTION

As an example of the FREDCON process design, the inorganic chemical waste (ICW) stream from a PWR is considered. Table 1 presents data on a water balance of the ICW stream. The water balance reflects a dissociation of $Na_zSO_4$ which in turn would cause $C_aSO_4$ to precipitate. The $Ca^{2+}$ concentration would then be $2.04\times10^{-3}$ Moles/liter and the final $SO_4^{2-}$ concentration would be $9.56\times10^{-2}$ Moles/liter.

TABLE 1

| Inorganics | Formula Weight | Valence | Equivalent Weight | ppm | epm (+) | epm (−) | Moles/liter |
|---|---|---|---|---|---|---|---|
| $HCO_3$ | 61 | −1 | 61 | 1,200 | | 19.7 | 0.0197 |
| Cl | 35.5 | −1 | 35.5 | 200 | | 5.6 | 0.0056 |
| $NO_3$ | 62 | −1 | 62 | 100 | | 1.6 | 0.0016 |
| Ca | 40 | +2 | 20 | 200 | 10 | | 0.005 |
| Mg | 24.3 | +2 | 12.2 | 100 | 8.2 | | 0.0041 |
| $NH_4$ | 18 | +1 | 18 | 100 | 5.6 | | 0.0056 |
| $Na_2SO_4$ | 142 | | | 14,000 | | | |
| Na | 23 | +1 | 23 | 4,536 | 197.2 | | 0.197 |
| $SO_4$ | 96 | −2 | 48 | 9,465 | | 197.2 | 0.09859 |

Figure 1:
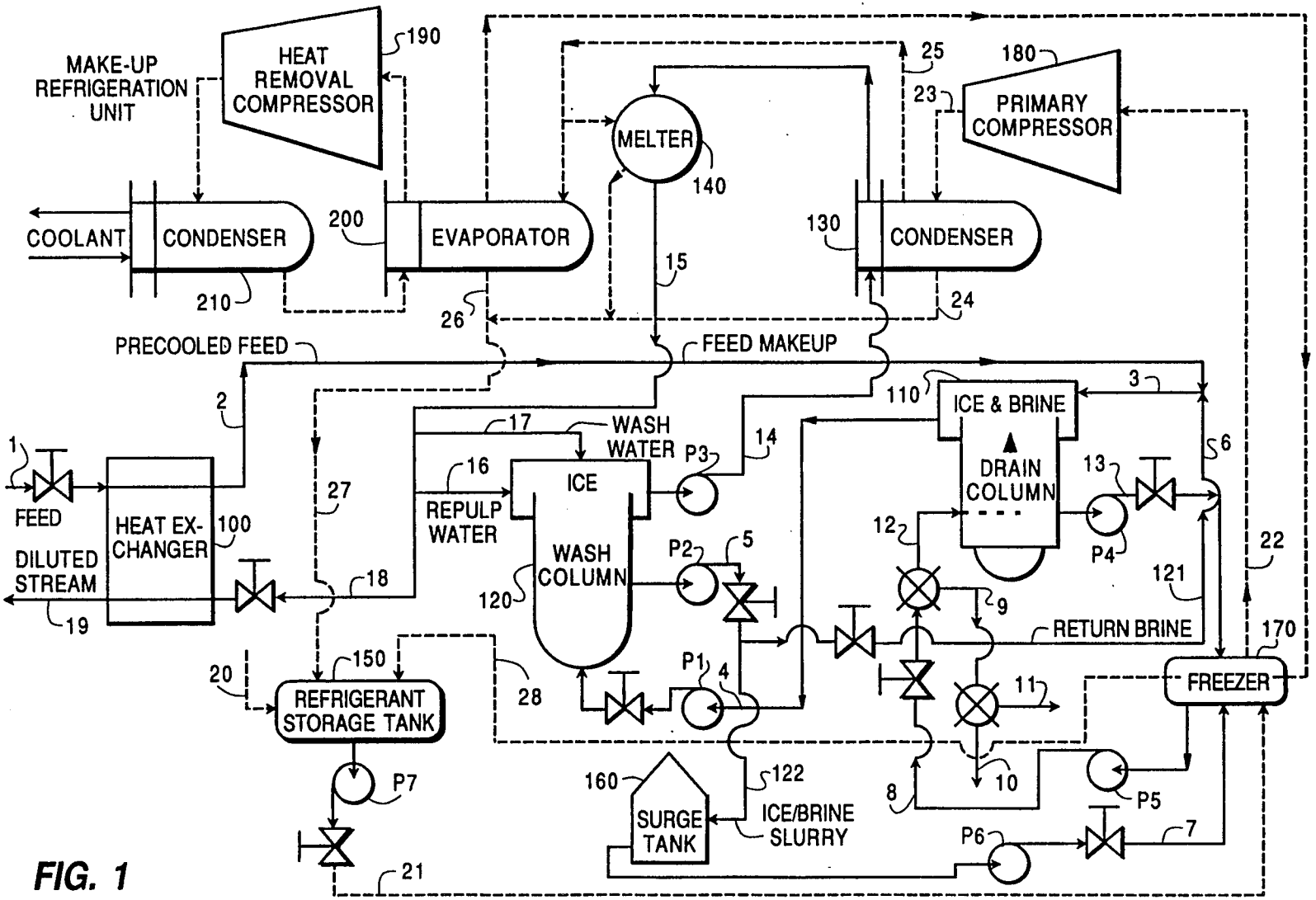
FIG. 1 schematically depicts freezing by the FEUBIC process.

FIG. 1 illustrates freezing by the FEUBIC process. In this process, feed make-up is supplied via a valve (unnumbered) to a heat exchanger 100 where it exits as a precooled feed 2. The precooled feed 2 mixes with return brine 6 to form a repulp brine 3, which is supplied to an ice and brine drain column 110.

An ice/brine slurry 4 leaves the column 110 and is input via a pump cap P1 to an ice wash column 120. The column 110 receives an ice/brine slurry 12. The column 110 outputs, via a pump P4, a recycle brine 13 which joins with a return brine 121 from the column 120, to form the return brine 6. Excess mixture is supplied to a freezer 170.

The ice wash column 120 outputs a return brine 5 via a pump P2. The return brine 5 splits into the return brine 121 and an ice/brine slurry 122. The slurry 122 is supplied to a surge tank 160 which in turn outputs a freezer feed 7 via a pump P6. The freezer feed 7 is supplied to the freezer 170. The freezer 170 outputs an ice/hydrate/brine slurry 8 via a pump P5, which is then supplied as an ice/brine slurry 12 to the column 110, as well as a hydrate/brine slurry 9 which is separated at a separator (unnumbered) into salt solids 10 and brine filterate 11.

The freezer 170 supplies ammonia vapors 22 to a primary compressor 180, which then outputs compressed ammonia vapors 23. The compressed ammonia vapors 23 are supplied to a condenser 130 which outputs ammonia condensate 24 and ammonia vapors 25. Passing in heat exchange relationship in the condenser is a wash column discharge 14 from a pump P3, which on the discharge side of the condenser 130 a wash column discharge 14.

The melter 140 also receives ammonia vapors 25, and outputs a diluted stream/repulp water 15. The ammonia vapors 25 join the ammonia condensate 24 and ammonia condensate 26 from an evaporator 200.

The diluted stream/repulp water 15 is supplied as wash water 17 and as repulp water 16 to the ice wash column 120. The remainder of the water 15 is supplied as diluted stream water 18 to the heat exchanger 100, where it exits as the diluted stream water effluent 19.

As seen in FIG. 1, the ammonia flow path is indicated as dotted lines, while the liquid and ice flow paths are indicated in solid lines.

The freezer 170 supplies an ammonia condensate return to a refrigerant storage tank 150. The tank 150 receives an ammonia make-up 20 and also receives an ammonia condensate return 27 from the evaporator 200. The tank 150 outputs, via a pump P7, an ammonia feed 21 to the freezer 170.

A heat removal compressor 190 receives evaporated ammonia from the evaporator 200, and, in a heat removal stage, supplies the compressed ammonia to a condenser 210 where the ammonia is cooled by a coolant (unnumbered), thereby forming a make-up refrigeration unit. The output of condensed refrigerant 215 is then supplied to the evaporator 200 as coolant.

The pumps described are named as follows. Pump Pl is a drain column repulp slurry pump. Pump P2 is a wash column brine discharge pump. Pump P3 is a wash column repulp slurry pump. Pump P4 is a drain column brine discharge pump. Pump P5 is a freezer product pump. Pump P6 is a freezer feed pump. Pump P7 is an ammonia refrigerant pump.

Figure 2:
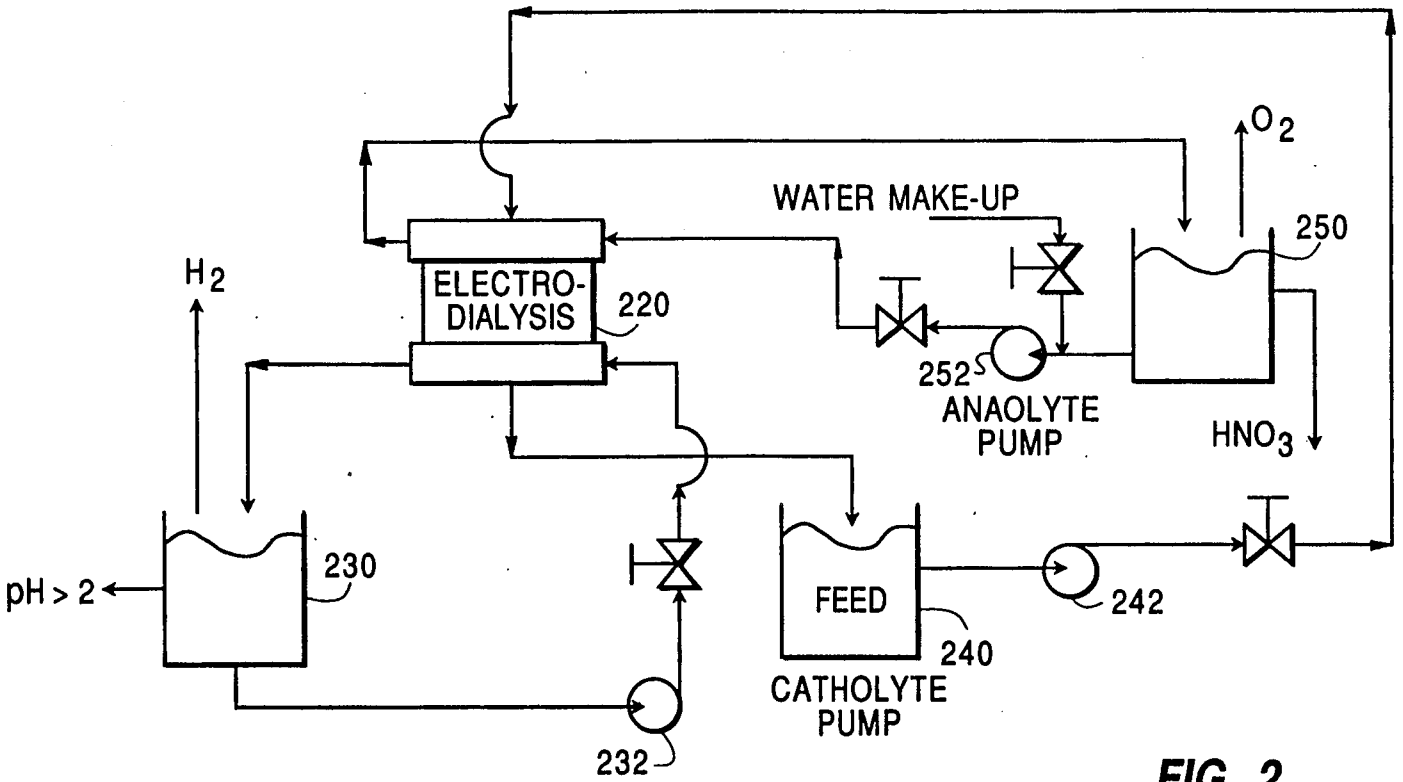
FIG. 2 schematically depicts a process for liquid lowlevel radioactive waste concentration.

FIG. 2 schematically shows a process for liquid low-level radioactive waste concentration using electrodialysis. An electrodialysis unit 220 has an output supplied to a feed 240. The feed 240 is returned to the electrodialysis unit 220 via a pump 242 controlled by a valve (unnumbered). An anaolyte pump 252 receives liquid from a tank 250 as well as water makeup from a valve (unnumbered) and supplies it via a valve (unnumbered) to a top portion of the electrodialysis unit 220, whereafter it returns to the tank 250. In this process, in the tank, oxygen molecules escape from the top of the tank, and $HNO^3$ is removed from the tank. In another fluid flow loop, a tank 230 supplies catholyte liquid via a catholyte pump 232 via a valve (unnumbered) to a lower portion of the electrodialysis unit 220. This liquid is then returned to the tank 230. Hydrogen molecules escape from the tank 230, and liquid is drained off having a pH which is greater than 2. FIG. 2 illustrates the processing of radioactive waste by a RADWED.

Figure 3:
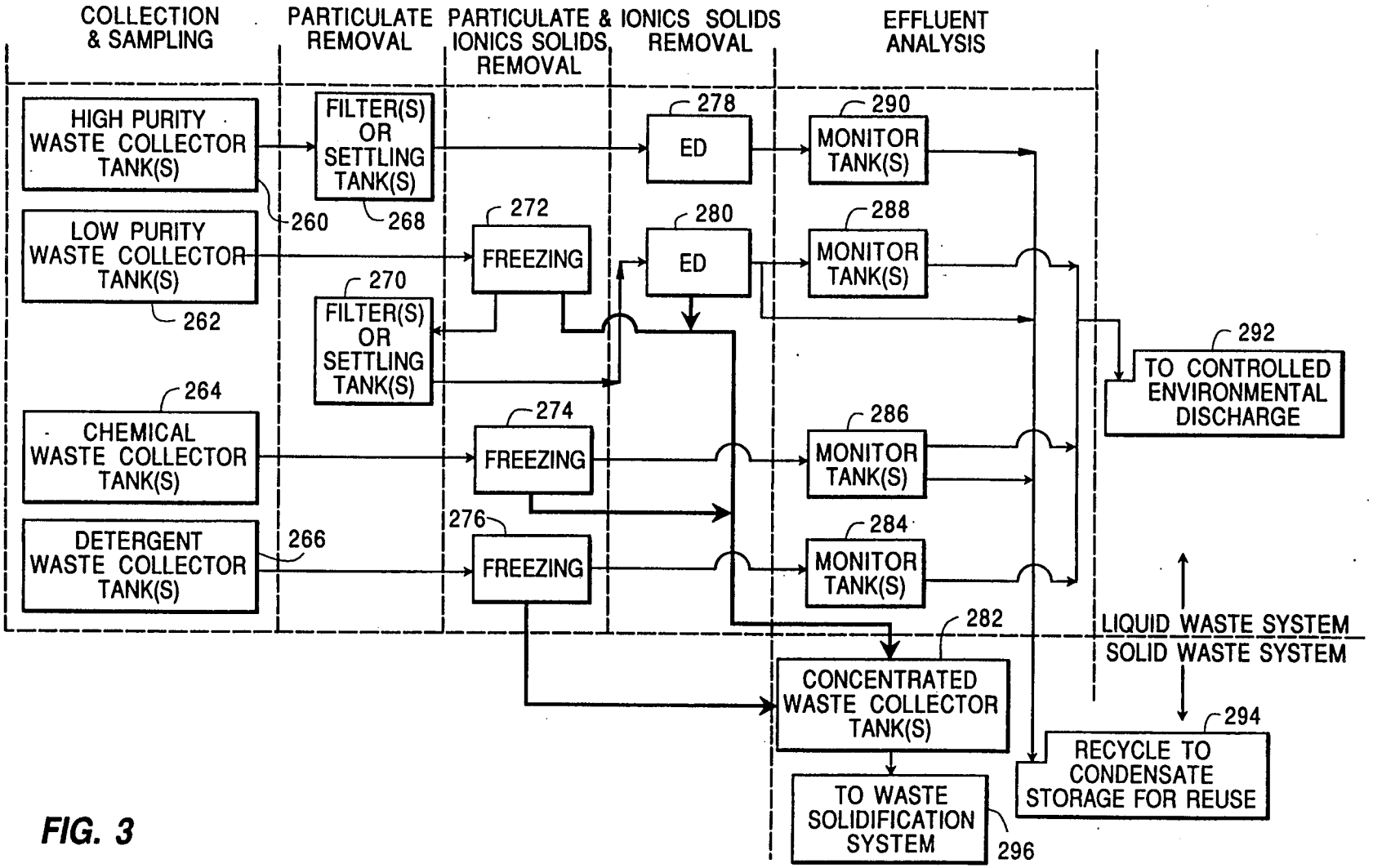
FIG. 3 is a schematic diagram representing the FREDCON liquid radioactive waste system for a boiling water reactor.

FIG. 3 illustrates a preferred embodiment of the FREDCON process in processing various streams of a boiling water reactor in a nuclear power plant. A collection and sampling zone in the figure includes elements 260, 262, 264, and 266 which represent liquids of differing types to be processed. High purity waste 260 is supplied to filters 268 and then to an electrodialysis process 278. From there, liquid is supplied to monitor tanks 290 and from there to a storage 294 to recycle condensate for reuse.

Low purity waste 262 is supplied to a freezing process 272 which supplies concentrated waste to a storage tank 282 which in turn supplies material to a waste solidification system 296. Chemical waste 264 is supplied to a freezing unit 274 which supplies effluent to monitor tanks 286 and supplies concentrated waste to storage tank 282. Detergent waste 266 is supplied to a freezing process 276, whereafter liquid effluent is supplied to monitor tanks 284, and concentrated effluent is supplied to tanks 282. Liquid from the monitor tanks is supplied to a controlled environmental discharge 292.

The freezing processing shown in FIG. 3 include particulate an ionics solids removal. The filters shown in FIG. 3 are for particulate removal. The electrodialysis units are for ionics solids removal. The monitor tanks, concentrated waste storage tank 282, waste solidification system 296, form part of the effluent analysis portion of the system. Affluent from the monitor tanks 288, 286, and 284 is supplied to the controlled discharge 292. The affluent of the monitor tank 290 is stored at 294 for reuse.

Figure 4:
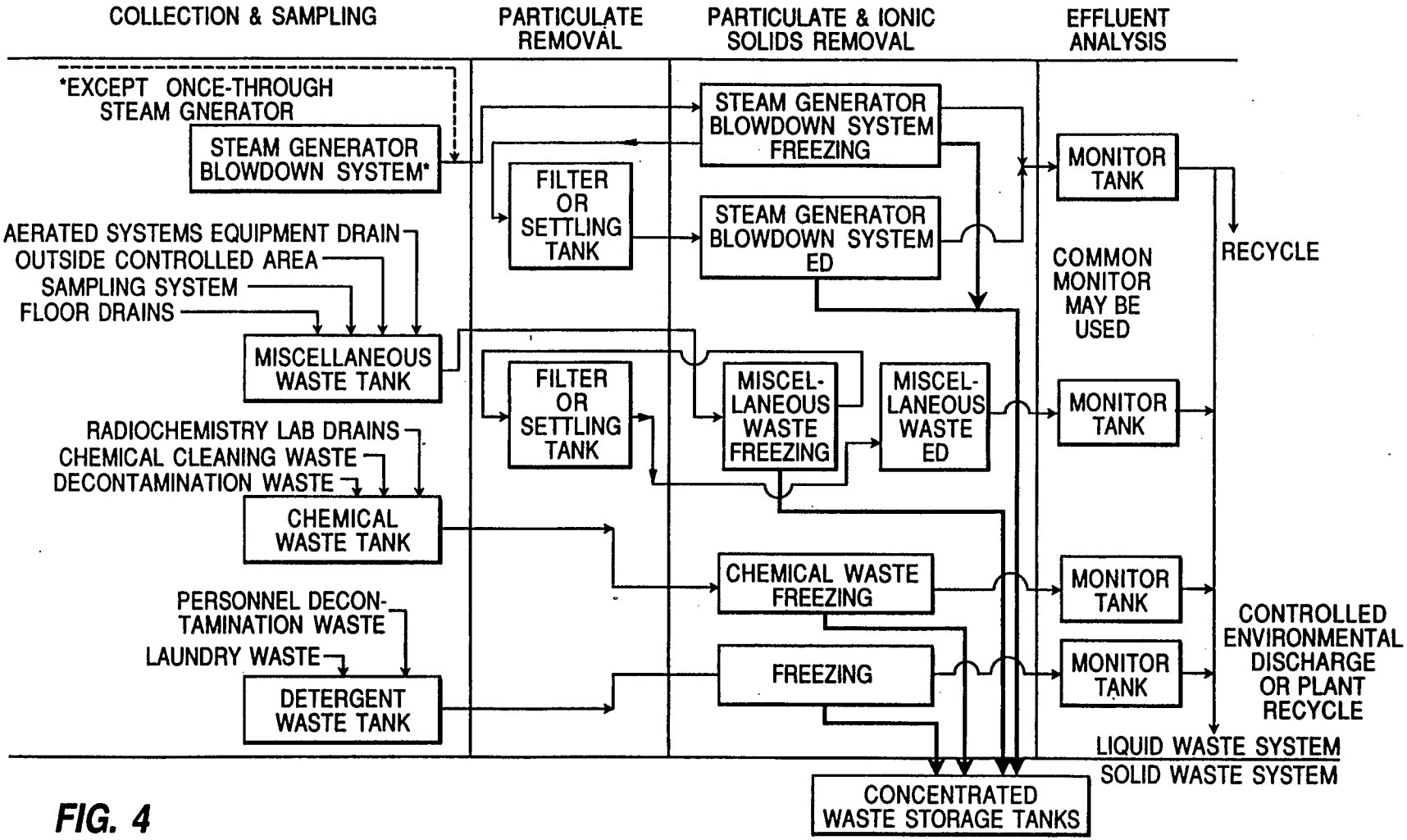
FIG. 4 depicts a system as shown in FIG. 3, as used for a pressurized water reactor.

FIG. 4 shows the FREDCON process for a pressurized water reactor. The contents schematically depicted in FIG. 4 are similar to that shown in FIG. 3 previously described.

Figure 5:
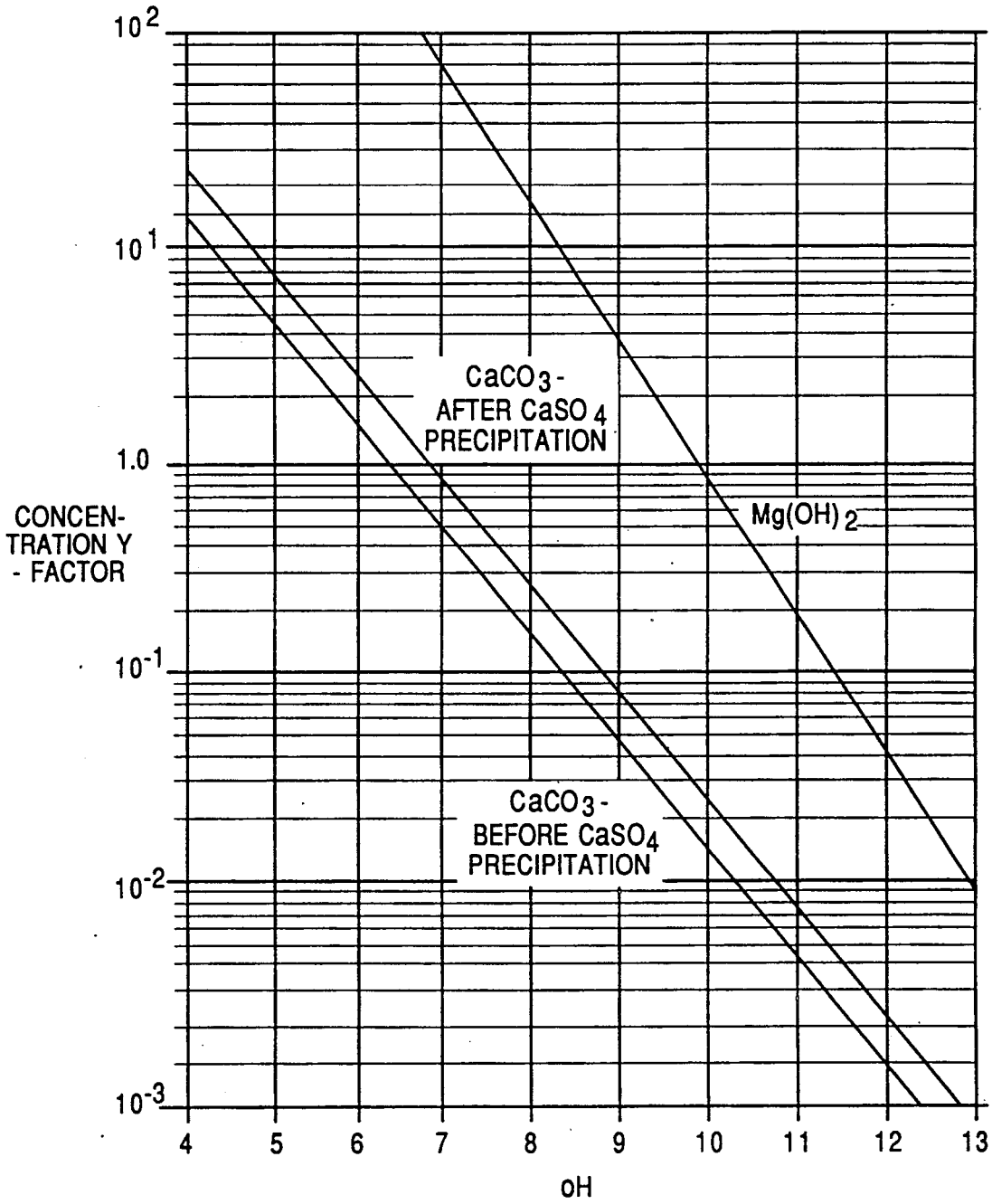
FIG. 5 is a graph showing concentration of a gamma factor versus pH.

FIG. 5 presents plots of concentration "y-factor" for $CaCO_3$ and $Mg(OH)_2$ at selected values of pH. The ion products are based on the ICW stream data. The $CaCO_3$ plots present cases for both before and after $CaCO^3$ precipitation.

Figure 6:
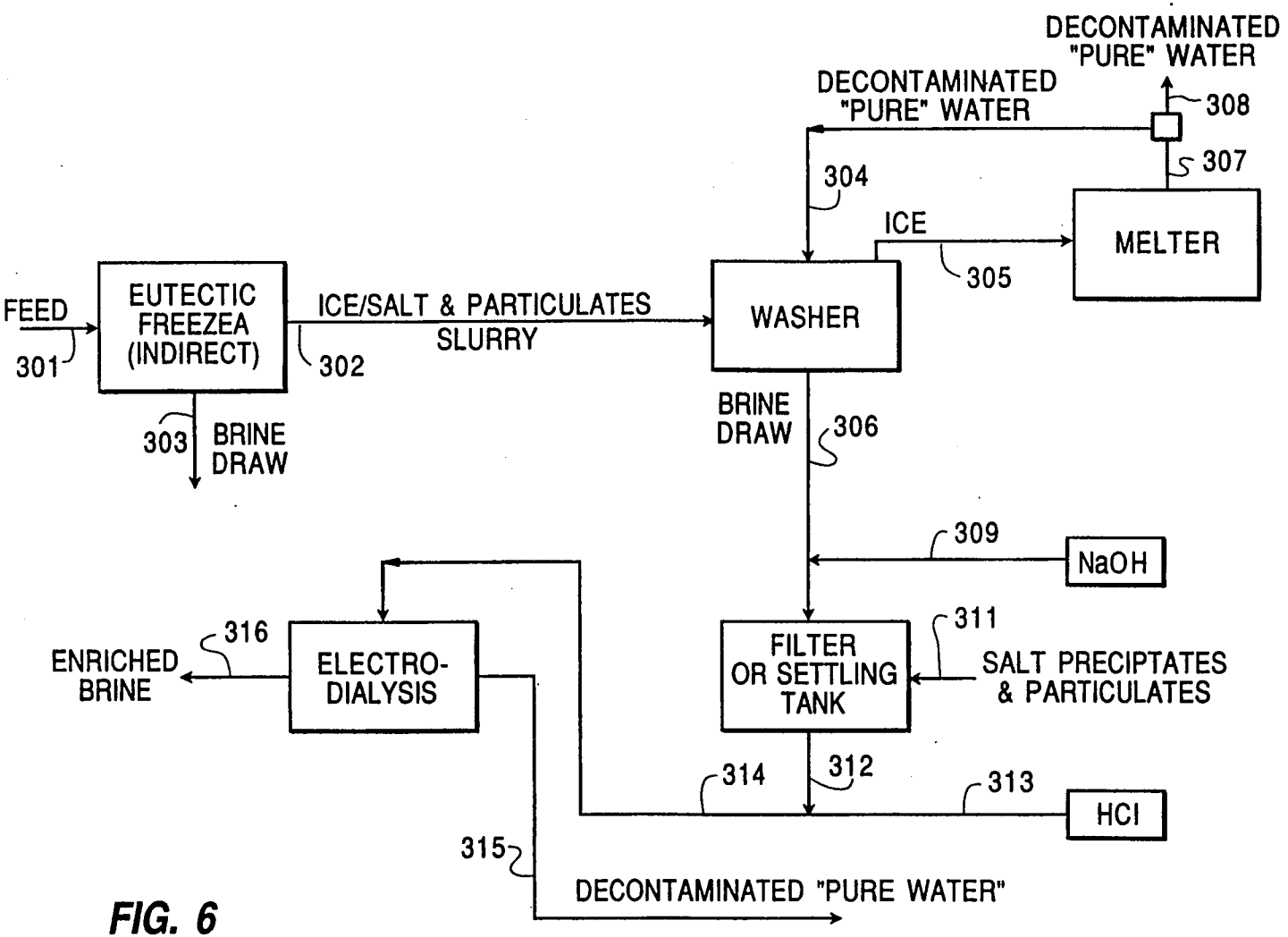
FIG. 6 schematically illustrates a process sheet for an example according to the present invention.

FIG. 6 shows the process sheet, and Table 2 lists the material flow rates at each numbered position thereof. The ICW feed enters the FEUBIC process 301 where ice is formed in the freezer. A slurry of ice/salts and particulates is directed to the washer 302. Five percent (5%) of $H_2O$ is assumed to be brine covering the ice. Brine is drawn from the freezer 303, or it may be recycled to increase the concentration rate. In the washer, a portion of the decontaminated "pure" water 304 is recycled to wash away the brine adhering to the ice crystals. The washed ice 305 is directed to a melter and the brine which contains salt precipitates and particulates 306 is prepared for further processing by the RADWED. The decontaminated "pure" water stream from the melter 307 is partitioned into a small portion to provide wash water for the washer and the rest is then released to the environment 308.

In the RADWED process, NaOH 309 is added to the brine from the FEUBIC process. The solution 310 then passes through a filter or a settling tank wherein salt precipitates and particulates 311 are separated from the brine 312. HCl 313 is added to adjust for pH of the brine stream. The adjusted stream 314 enters the ED stacks, where decontaminated "pure" water 315 is extracted leaving a concentrated enriched brine stream 316 for further processing. The overall recovery rate of

TABLE 2

| POSITION | 301 | 302* | 303 | 304 |
|---|---|---|---|---|
| DISSOLVED INORGANICS | | | | |

TABLE 2-continued

| | | | | |
|---|---|---|---|---|
| $[SO_4^{-2}]$ | 0.0986 M | 0.0468 | 0.9360 | $4.68 \times 10^{-3}$ |
| $[HCO_3^-]$ | 0.0197 M | $9.85 \times 10^{-3}$ | 0.1970 | $9.85 \times 10^{-4}$ |
| $[CO_3^{-2}]$ | $9.22 \times 10^{-6}$ M | $4.61 \times 10^{-6}$ | $9.22 \times 10^{-5}$ | $4.61 \times 10^{-7}$ |
| $[H^+]$ | $1.00 \times 10^{-7}$ M | $1.00 \times 10^{-7}$ | $1.00 \times 10^{-7}$ | $1.00 \times 10^{-7}$ |
| $[Cs^+]$ | $1.00 \times 10^{-11}$ M | $5.00 \times 10^{-12}$ | $1.00 \times 10^{-10}$ | $5.00 \times 10^{-13}$ |
| $[CA^{+2}]$ | 0.0050 M | $1.2425 \times 10^{-6}$ | $2.485 \times 10^{-5}$ | $1.2425 \times 10^{-7}$ |
| $[Mg^{+2}]$ | 0.0041 M | $2.05 \times 10^{-3}$ | 0.0410 | $2.05 \times 10^{-4}$ |
| $[Sr^{+2}]$ | $1.00 \times 10^{-12}$ M | $5.00 \times 10^{-13}$ | $1.00 \times 10^{-11}$ | $5.00 \times 10^{-14}$ |
| OTHER ANIONS | | | | |
| $(CL^-, NO_3^-)$ | 0.006082 M | $3.041 \times 10^{-3}$ | 0.06082 | $3.041 \times 10^{-4}$ |
| POSITION | 305 | 306 | 307 | 308 |
| DISSOLVED INORGANICS | | | | |
| $[SO_4^{-2}]$ | $4.68 \times 10^{-3}$ | 0.18240 | $4.68 \times 10^{-3}$ | $4.68 \times 10^{-3}$ |
| $[HCO_3^-]$ | $9.85 \times 10^{-4}$ | 0.03837 | $9.85 \times 10^{-4}$ | $9.85 \times 10^{-4}$ |
| $[CO_3^{-2}]$ | $4.61 \times 10^{-7}$ | $1.796 \times 10^{-5}$ | $4.61 \times 10^{-7}$ | $4.61 \times 10^{-7}$ |
| $[H^+]$ | $1.00 \times 10^{-7}$ | $1.00 \times 10^{-7}$ | $1.00 \times 10^{-7}$ | $1.00 \times 10^{-7}$ |
| $[Cs^+]$ | $5.00 \times 10^{-13}$ | $1.95 \times 10^{11}$ | $5.00 \times 10^{-13}$ | $5.00 \times 10^{-13}$ |
| $[CA^{+2}]$ | $1.2425 \times 10^{-7}$ | $1.392 \times 10^{-4}$ | $1.2425 \times 10^{-7}$ | $1.2425 \times 10^{-7}$ |
| $[Mg^{+2}]$ | $2.05 \times 10^{-4}$ | $7.99 \times 10^{-4}$ | $2.05 \times 10^{-4}$ | $2.05 \times 10^{-4}$ |
| $[Sr^{+2}]$ | $5.00 \times 10^{-14}$ | $1.95 \times 10^{-11}$ | $5.00 \times 10^{-14}$ | $5.00 \times 10^{-14}$ |
| OTHER ANIONS | | | | |
| $(CL^-, NO_3^-)$ | $3.041 \times 10^{-4}$ | $1.185 \times 10^{-2}$ | $3.041 \times 10^{-4}$ | $3.041 \times 10^{-4}$ |

decontaminated "pure" water is about 90%. Further reduction in the radwaste volume effluent can be achieved by recycling the drawn brine 330 in the FEUBIC process.

Combination of both FEUBIC and RADWED processes in the FREDCON process leads to a small volume of concentrated radioactive matter that is ready for appropriate disposal and a diluted pure water stream that can be recycled in the plant or safely released to the environment. The released water can meet the regulatory limits. No pre- or post- treatment of the waste stream is required. Also, the process will only generate minimal secondary solid or liquid waste streams. Current WMSs vis-a-vis FREDCON produces extensive secondary waste streams that increase the volume of the concentrated stream or add to the solid waste volume to be disposed of.

In the design of the FEUBIC component of FREDCON, several features prevail. The FEUBIC process does not require pretreatment or sorting of waste. The indirect freezing utilized in the FEUBIC process has the merits of being simple conceptually and mechanically while no stringent constraints are imposed on the construction since the process takes place at atmospheric pressure. Since there is no contact between the radwaste stream and the refrigerant in FEUBIC, no further contamination will take place in the LWMS.

In the RADWED component of FREDCON, the radwaste treatment is simple, no regeneration processes are necessary, and the interference due to the coexistent of inactive and radioactive ions is minor.

FREDCON is suitable for processing of aqueous solution wastes in general where the product is a minimum waste volume. In particular, FREDCON is appropriate for volume reduction of radwaste from NPPs, fuel processing plants, uranium enrichment plants, plutonium production plants, and non-fuel cycle applications of nuclear energy.

The feed to the low level liquid radwaste management system comes from many sources in a PWR nuclear power plant. The treatment system can be centralized or designed specifically for each source. Typical streams and the associated treatment equipment for each sources are shown in FIG. 7.

Electrodialysis (ED) and freezing (FR) processes are shown for each source. Filtration (F) is shown as an illustrative means of solids removal although other means such as a cyclone separator are equally appropriate if not preferred when the solid materials are radioactive.

Treatment of all streams by the ED/FR process is not necessarily beneficial compared with the current treatment processes. In particular, preliminary examination of the stream designated high purity wastes in FIG. 7 suggested that the ED/FR process would be of marginal benefit and that certainly this stream was not a principal stream for the hybrid process. The streams of major importance for the ED/FR process primarily include the streams feeding the chemical waste tank.

Figure 7:
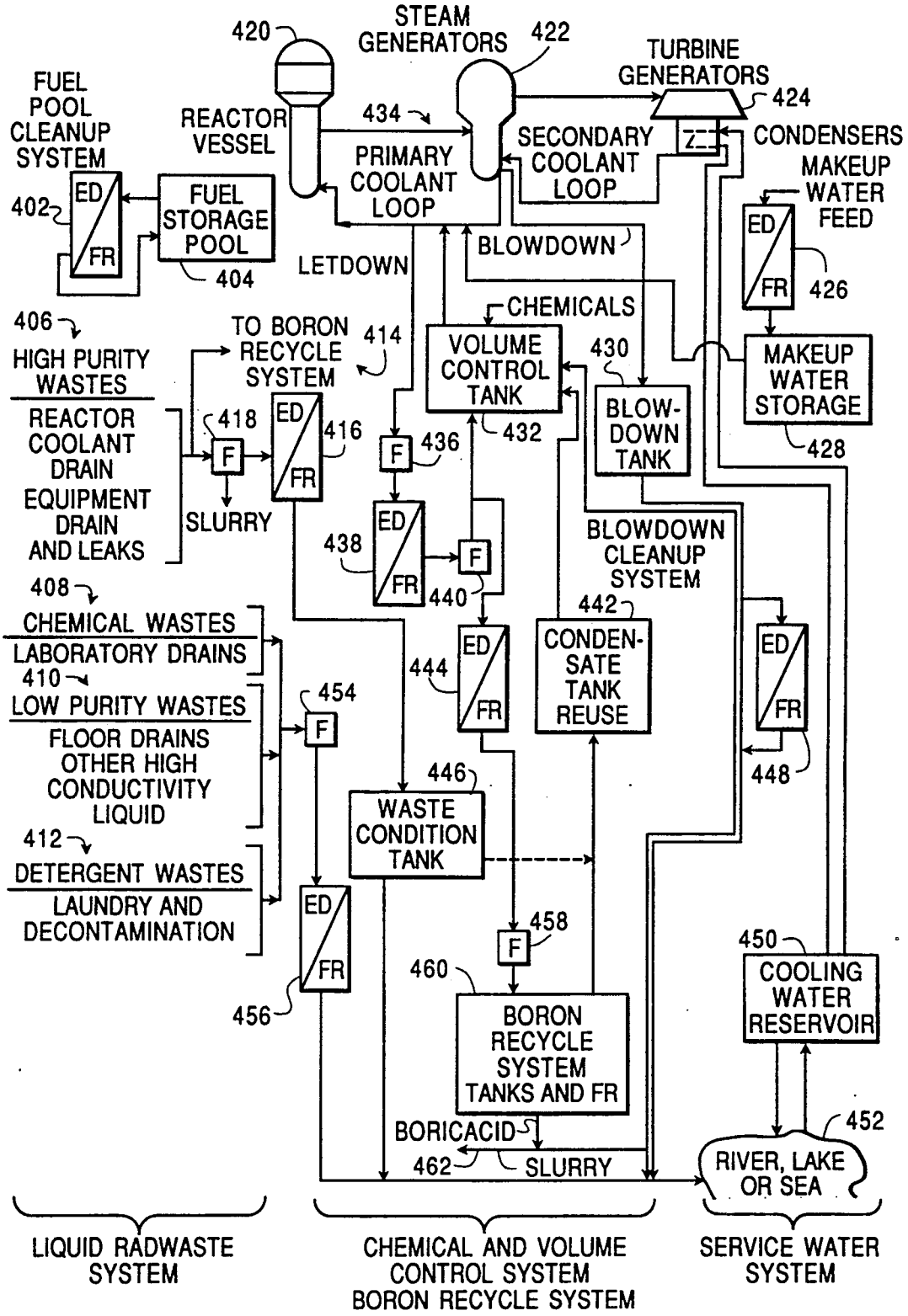
FIG. 7 represents a schematic diagram of liquid stream treatment by the present invention for a pressurized water reactor.

In FIG. 7, items 406, 408, 410, and 412 relate to various wastes which are processed by the system. These materials are supplied as seen in FIG. 7 to filtering units and electrodialysis units combines with freezing units as indicated in the drawings. The various elements are labelled in the drawings, each unit having an element designation number as shown. A reactor vessel 420 is shown supplying steam 434 to steam generators 422, the steam driving turban generators 424. Electrodialysis/-freezer process units 416, 456, 438, 444, and 448 are shown at appropriate locations in the system as indicated.

Figure 8:
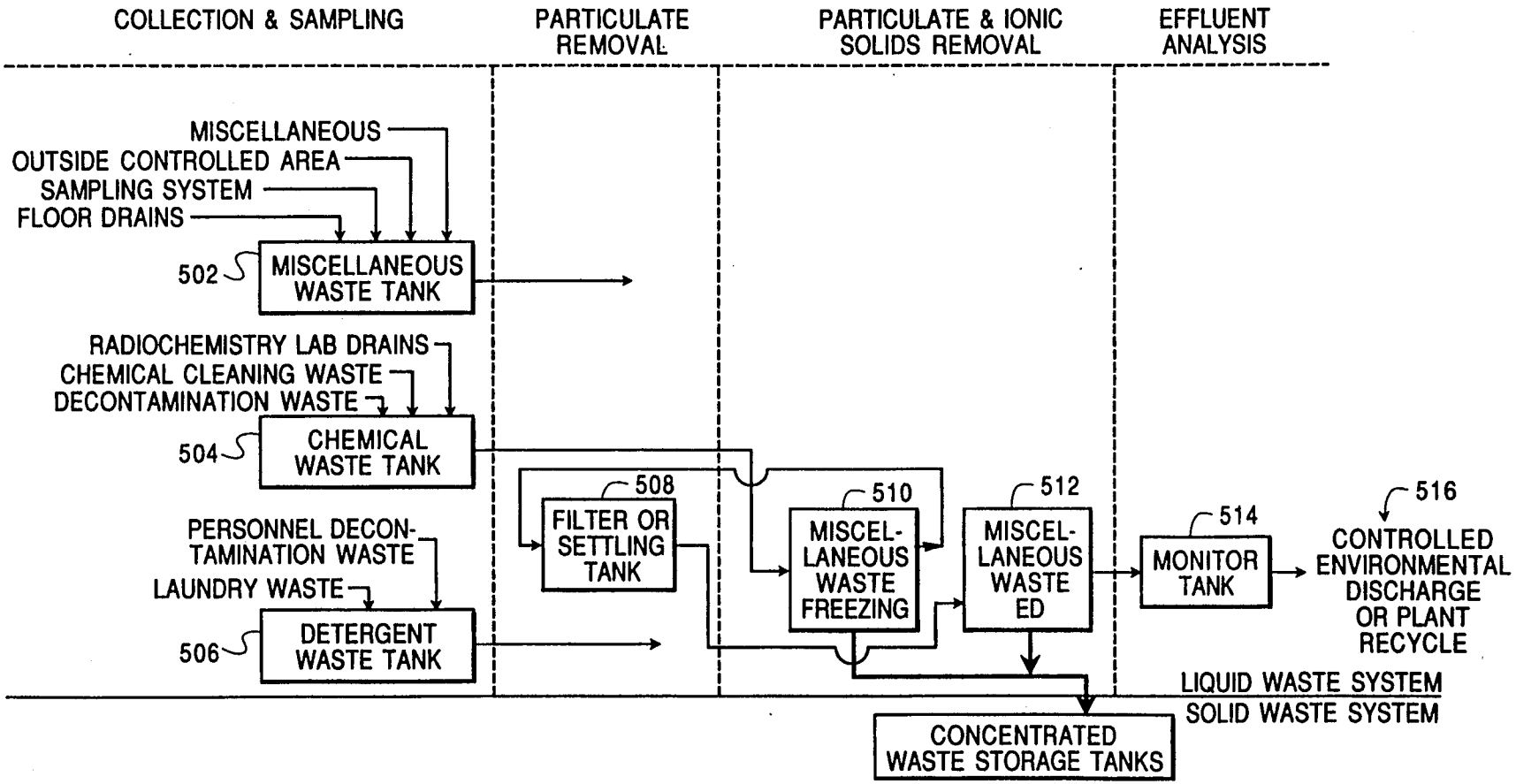
FIG. 8 is a schematic diagram similar to FIG. 4, for the system shown in FIG. 7.

FIG. 8 is a schematic diagram showing the flow of material from collection and sampling units labelled in FIG. 8, to particulate removal steps 508, and particulate in ionic solids removal steps 510 and 512, and finally to an effluent analysis step at monitor tank 514. After this, there is controlled environmental discharge or plant recycling of liquid 516. Solid waste is supplied to concentrated waste storage tanks (unnumbered in FIG. 8).

In addition, the low purity wastes (miscellaneous wastes) and detergent wastes could be effectively treated by the ED/FR process. Depending on the specific contaminants, these three streams could be treated most effectively in a centralized system as suggested in FIG. 7 or the secondary streams could be treated by some other means as indicated in FIG. 8. The water analysis for the primary stream in the waste stream is given in Table 3.

Besides the option of centralized versus decentralized system, the sequence of the ED and FR processes and the choice of operating conditions are process options which need to be considered.

TABLE 3

SUMMARY OF PERFORMANCE OF THE HYBRID PROCESS AS A FUNCTION OF THE PROCESS SEQUENCE AND CONDITIONS

| Process Sequence | Scenario # | BLOWDOWN FROM CHEMICAL TREATMENT TDS | PARTICULATES/ $H_2O$ FOW | TOTAL SOLIDS CONCEN-TRATION (%) | TOTAL VOLUME FRACTION |
|---|---|---|---|---|---|
| Primary freezing | 1 | 5,279 | 1.68/7,633 | 22.54 | 0.00242 |
| process with | 2 | 8,490 | 1.89/4,677 | 41.26 | 0.00148 |
| chemical precipi- | 3 | 3,977 | 1.58/12,639 | 12.90 | 0.00400 |
| tation of wash water | 4 | 4,849 | 1.58/10,308 | 15.81 | 0.00326 |
| and subsequent | 5 | 2,772 | 1.58/18,896 | 8.64 | 0.00598 |
| treatment by ED | 6 | 3,006 | 1.58/17,347 | 9.41 | 0.00549 |
| Pretreatment by | 7 | 1.961 | 2.114/31,600 | 6.89 | 0.01000 |
| chemical precipita- | 8 | 1,961 | 2.114/31,600 | 6.89 | 0.01000 |
| tion and primary ED | 9 | 1,961 | 2.114/31,600 | 6.89 | 0.01000 |
| process with brine | 10 | 1,961 | 2.114/31,600 | 6.89 | 0.01000 |
| concentration by | 11 | 1,961 | 2.114/31,600 | 6.89 | 0.01000 |
| subsequent freezing | 12 | 1,961 | 2.114/31,600 | 6.89 | 0.01000 |
| treatment | | | | | |

Design Parameters for Processing PWR Inorganic Streams§

| POSITION | 1 | 2* | 3 | 4 | 5 | 6 | 7 | 8 |
|---|---|---|---|---|---|---|---|---|
| DISSOLVED INORGANICS | | | | | | | | |
| OTHER CATIONS | | | | | | | | |
| ($Na^+$, $NH_4^+$) | 0.2048 M | 0.1024 | 2.048 | 0.01024 | 0.01024 | 0.3989 | 0.01024 | 0.01024 |
| Total Dissolved Inorganics (Normality) | 0.2230 M | 0.1115 | 2.230 | 0.01115 | 0.01115 | 0.4343 | 0.01115 | 0.01115 |
| TDS [Inorganics] (mg/l) | ≈16,000 | ≈8,000 | ≈160,000 | ≈800 | ≈800 | ≈31,000 | ≈800 | ≈800 |
| $H_2O$ (kg/hr.) | 3,160 | 2,844 | 316 | 543 | 2,716 | 671 | 2,716 | 2,173 |
| $CaSO_4$ (kg/hr.) | — | 21.5 | — | — | — | 4.55 | — | — |
| $CaCO_3$ (kg/hr.) | — | — | — | — | — | — | — | — |
| $Mg(Ou)_2$ (kg/hr.) | — | — | — | — | — | — | — | — |
| Mg $CO_3$ (kg/hr.) | — | — | — | — | — | — | — | — |
| $^{90}Sr$ $SO_4$ (kg/hr.) | — | — | — | — | — | — | — | — |
| Particulates [@ 1,000 ppm] (kg/hr.) | 3.16 | 3.16 | — | — | — | 3.16 | — | — |

| POSITION | 9 | 10 | 11** | 12 | 13 | 14 | 15 | 16 |
|---|---|---|---|---|---|---|---|---|
| DISSOLVED INORGANICS | | | | | | | | |
| [$SO_4^{-2}$] | — | 0.1824 | 0.18240 | 0.18240 | — | 0.18240 | $4.68 \times 10^{-3}$ | 1.26 |
| [$HCO_3^-$] | — | 0.02041 | 0.02041 | 0.02041 | — | 0.02041 | $5.23 \times 10^{-4}$ | 0.141 |
| [$CO_3^{-2}$] | — | $1.782 \times 10^{-2}$ | $1.782 \times 10^{-2}$ | $1.782 \times 10^{-2}$ | — | $1.782 \times 10^{-2}$ | $4.57 \times 10^{-4}$ | 0.123 |
| [$H^+$] | $4.00 \times 10^{-16}$ | $1.00 \times 10^{-10}$ | $1.00 \times 10^{-10}$ | $1.00 \times 10^{-10}$ | 10 | $1.00 \times 10^{-7}$ | $1.00 \times 10^{-7}$ | $1.00 \times 10^{-7}$ |
| [$Cs^+$] | — | $1.95 \times 10^{-11}$ | $1.95 \times 10^{-11}$ | $1.95 \times 10^{-11}$ | — | $1.95 \times 10^{-11}$ | $5.00 \times 10^{-13}$ | $1.35 \times 10^{-10}$ |
| [$Ca^{+2}$] | — | $2.54 \times 10^{-7}$ | $2.54 \times 10^{-7}$ | $2.54 \times 10^{-7}$ | — | $2.54 \times 10^{-7}$ | $6.51 \times 10^{-9}$ | $1.75 \times 10^{-6}$ |
| [$Mg^{+2}$] | — | $1.20 \times 10^{-3}$ | $1.20 \times 10^{-3}$ | $1.20 \times 10^{-3}$ | — | $1.20 \times 10^{-3}$ | $3.08 \times 10^{-5}$ | $8.38 \times 10^{-3}$ |
| [$Sr^{+2}$] | — | $1.95 \times 10^{-12}$ | $1.95 \times 10^{-12}$ | $1.95 \times 10^{-12}$ | — | $1.95 \times 10^{-12}$ | $5.00 \times 10^{-14}$ | $1.35 \times 10^{-11}$ |
| OTHER ANIONS | | | | | | | | |
| ($CL^-$, $NO_3^-$) | 25 | $1.195 \times 10^{-2}$ | $1.195 \times 10^{-2}$ | $1.195 \times 10^{-2}$ | — | $1.195 \times 10^{-2}$ | $3.064 \times 10^{-4}$ | $8.25 \times 10^{-2}$ |
| OTHER CATIONS | | | | | | | | |
| ($Na^+$, $NH_4^+$) | 25 | 0.3990 | 0.3990 | 0.3990 | — | 0.3990 | 0.01023 | 2.75 |
| Total | 25 | 0.4343 | 0.4343 | 0.4343 | — | 0.4343 | 0.11136 | 3.00 |

TABLE 3-continued

| | | | | | | | | |
|---|---|---|---|---|---|---|---|---|
| Dissolved Inorganics (Normality) | | | | | | | | |
| TDS [Inorganics] (mg/l) | $1.00 \times 10^{-}$ | ≈31,000 | ≈31,000 | ≈31,000 | ≈365,000 | ≈31,000 | ≈800 | 214,000 |
| $H_2O$ (kg/hr.) | $2.68 \times 10^{-3}$ | 637 | 34 | 603 | $6.0 \times 10^{-6}$ | 603 | 513 | 90 |
| $CaSO_4$ (kg/hr.) | — | 4.55 | 4.55 | — | — | — | — | — |
| $CaCO_3$ (kg/hr.) | — | 0.009 | 0.009 | — | — | — | — | — |
| $Mg(Ou)_2$ (kg/hr.) | — | 0.252 | 0.252 | — | — | — | — | — |
| Mg $CO_3$ (kg/hr.) | — | — | — | — | — | — | — | — |
| $^{90}Sr$ $SO_4$ (kg/hr.) | — | — | — | — | — | — | — | — |
| Particulates [@ 1,000 ppm] (kg/hr.) | — | 3.16 | 3.16 | — | — | — | — | — |

§Positions are indicated on EXHIBIT 7 and the water balance of the ICW stream data is provided in EXHIBIT 5.
*Assumes 5% of $H_2O$ is brine covering the ice and 90% $H_2O$ is in the form of ice.
**Assumes 5% blowdown.
Assumes 20% of $H_2O$ from melter is used to wash ice to a point where only 0.5% of $H_2O$ is brine covering the ice and 0.45% of ice is melted and lost with brine.

The major parameters considered for the operating conditions involve the freezing process; that is, (1) the percentage of the water from the melter that is used to wash the ice slurry in the washer, and
(2) the percentage of water in the ice slurry that occurs as brine.

The other operating conditions, include, (1) the percentage blowdown in the chemical precipitation step (for solids separation),
(2) the pH of the chemical precipitation,
(3) the percentage of the feed water that becomes the ice slurry,
(4) the percentage of the washed ice water that remains as brine, and
(5) the percentage of the ice that is melted in the wash step and lost to the wash water, are held at nominal values.

The process sheet for the hybrid process with the freezing process first is shown schematically in FIG. 6. A summary of the cases evaluated in terms of the two variable parameters selected for the operating conditions is given in Table 4.

CRITERIA FOR PROCESS SELECTION

The criteria for process selection include, (1) the decontamination factor for the diluted stream, achieved by the process,

TABLE 4

| % Slurry $H_2O$ as Brine | 5% | 25% | 50% |
|---|---|---|---|
| % Melter $H_2O$ Used as Wash | | | |
| 10% | 2/8 | 4/10 | 6/12 |
| 20% | 1/7 | 3/9 | 5/11 |

(2) the concentration factor of soluble salts (including the radioactive elements),
(3) the solids (suspended and dissolved) content in the flow-down from the solids separator, and
(4) the overall volume reduction in the radioactive liquid stream.

For each criterion, the maximum value is sought for the overall process.

COMPUTER SIMULATION OF SYSTEM PERFORMANCE

Because of the complexity of the concentrator, a computer model of the hybrid process was developed. This model simulates the performance of a combined ED-freezing process with a classical chemical treatment and clarification step to remove suspended particulates and any precipitated material. In order to select the optimal sequence of treatment stages for a given radioactive waste stream, several scenarios have been evaluated. Those scenarios involve two arrangements; namely;

* FRED: a freezing unit followed by ED, and
* EDFRA: an ED unit followed by a freezing unit.

In both cases; the feed to the ED section is pretreated by chemical means, that is pH adjusted to pH 10 and all solid materials separated by settling an clarification equipment. The feed stream to the system is the organic chemical waste stream from PWR nuclear power plant. The sources of this stream are listed in FIG. 8 and primarily include the sources feeding the chemical waste tank.

For a centralized treatment system, the sources could also include those feeding the miscellaneous waste tank and the detergent waste tank.

The water analysis for the waste stream under consideration is given in Table 1. The process sheet for the combined system is given in FIG. 6. There are two locations for decontaminated water to be released from the system; namely points 308 and 315. These are respectively the product water outlets of the freezing process and the ED process.

There are three sources of radioactive brine, namely;

* the brine drawn from the freezer at point 303.
* the enriched brine from the ED section at point 316, and
* the blowdown from the chemical treatment section at point 311.

The freezer and ED sections are linked via the wash water from the freezing process at point 306.

In the cases of the freezer and the chemical treatment section where the formation of solids is not necessarily a problem, each of the brine and blowdown requires about one percent of the feed water. The enriched brine in the ED section is limited by the solubility limits of the remaining salts in the treated wash water and by electro-osmotic transfer of water with the salt. In the later case, the final brine concentration is about 3 equivalents per kg of water. If the solubility of one of the salts is exceeded before the electro-osmotic limit, the brine concentration will be less since the ED system will

TABLE 5

FRED SEQUENCE FOR CASE 1 CONDITIONS
RESULTS FOR THE FREEZING PROCESS

FRED.FREEZE.VC1

Design Parameters for Processing PWR Inorganic Streams (Part 1; Freeze/Wash/Melt)

| | | | |
|---|---|---|---|
| Percent Feed Water to Slurry: | 99 | Percent Water Recovery: | 74.84 |
| Percent Slurry H2O as Brine: | 5 | Percent Water Delivered to ED System: | 24.16 |
| Percent Washed Ice H2O as Brine: | .5 | | |
| Percent Melter H2O used as Wash: | 20 | | |
| Percent Ice melted and lost: | 1 | | |

| POSITION | 1 | 2 | 3 | 4 | 5 | 6 | 7 | 8 |
|---|---|---|---|---|---|---|---|---|
| DISSOLVED INORGANIC CONCENTRATIONS | | | | | | | | |
| [SO4=] Init. | | 0 | | | | 0 | | |
| [SO4=] Final | 0 | 0 | 0 | 0 | 0 | 0 | 0 | 0 |
| [HCO3−] INITIAL | .0197 | .2469896 | | | | .0472245 | | |
| [HCO3−] FINAL | .0196908 | .2468740 | .2468740 | .0012344 | .0012344 | .0472024 | .0012344 | .0012344 |
| [CO3=] INITIAL | | 1.549E−4 | | | | 3.158E−5 | | |
| [CO3=] FINAL | 9.215E−6 | 1.155E−4 | 1.55E−4 | 5.777E−7 | 5.777E−7 | 2.209E−5 | 5.777E−7 | 5.777E−7 |
| [H+] | .0000001 | .0000001 | .0000001 | .0000001 | .0000001 | .0000001 | .0000001 | .0000001 |
| [Cs+] | 1.E−11 | 1.68E−10 | 1.68E−10 | 8.40E−13 | 8.40E−13 | 3.18E−11 | 8.40E−13 | 8.40E−13 |
| [Ca+2] Init. | | 8.563E−5 | | 0 | 0 | 4.479E−4 | 0 | 0 |
| [Ca+2] Final | .005 | 8.563E−5 | 8.563E−5 | 4.282E−7 | 4.282E−7 | 4.479E−4 | 4.282E−7 | 4.282E−7 |
| [Mg+2] | .0041 | .0689076 | .0689076 | 3.445E−4 | 3.445E−4 | .0014263 | 3.445E−4 | 3.445E−4 |
| [Sr+2] | 1.68E−11 | 2.82E−10 | 2.82E−10 | 1.41E−12 | 1.41E−12 | 5.35E−11 | 1.41E−12 | 1.41E−12 |
| Other Anions (Cl−, NO3−) | .0072 | .1210084 | .1210084 | 6.050E−4 | 6.050E−4 | .0229222 | 6.050E−4 | 6.050E−4 |
| Other Cations (Na+, NH4+) | .0087092 | 0<br>.2301271 | .2301271 | .0011506 | .0011506 | 0<br>.0664203 | .0011506 | .0011506 |
| Total Dissolved Inorganics (Normality) | .0269092 | .3681135 | .3681135 | .0018406 | .0018406 | .0701687 | .0018406 | .0018406 |
| CHECK ANIONS | .0269092 | .3681135 | .3681135 | | | .0701688 | | |
| TDS [Inorganics] (milligram/liter) | 1957 | 26333 | 26333 | 131.6642 | 132 | 5275 | 131.6642 | 131.6642 |
| H2O (kg/hr) | 3160 | 3128.4 | 31.4 | 591.2676 | 2956.338 | 763.3296 | 2956.338 | 2365.070 |
| CaSO4 (x, molality) | | | | | | | | |
| CaSO4 (kg/hr) | | 0 | | | | 0 | | |
| CaCO3 (kg/hr) | | 1.580562 | | | | 1.545442 | | |
| Mg(OH)2 (kg/hr) | | | | | | | | |
| MgCO3 (kg/hr) | | 0 | | | | 0 | | |
| SrSO4 (kg/hr) | | | | | | | | |
| Particulates (@ 1000 ppm) (kg/hr) | 3.16 | 3.16 | | | | 3.16 | | |

FRED SEQUENCE FOR CASE 1 CONDITIONS
RESULTS FOR THE ELECTRODIALYSIS PROCESS

FRED.ED.VC1

TABLE 5-continued

Design Parameters for Processing PWR Inorganic Streams (Part 2; Filter/ED)

| | | | |
|---|---|---|---|
| Settling Tank pH: | 10 | ED PLANT Percent Water Recovery: | 97.69 |
| ED Unit Feed pH: | 7 | CHEMICAL PLANT RECOVERY: | 99 |
| DECONTAMINATION FACTOR: | 100 | OVERALL WATER RECOVERY: | .9671138 |
| Percent Settler Blowdown: | 1 | | |

| POSITION | 6 | 9 | 10 | 11 | 12 | 13 | 14 | 15 | 16 |
|---|---|---|---|---|---|---|---|---|---|
| DISSOLVED INORGANIC CONCENTRATIONS | | | | | | | | | |
| [SO4=], Init. | 0 | | | | | | | | |
| [SO4=], Final | 0 | 1.E−10 | 4.00E−16 | 4.00E−16 | 4.00E−16 | | 4.00E−16 | 4.00E−18 | 1.71E−14 |
| | .0472245 | | .0252523 | | | | | | |
| [HCO3−] | .0472024 | 1.E−10 | .0172018 | .0172018 | .0172018 | | .0172018 | 1.720E−4 | .7367139 |
| [CO3=], Init. | 3.158E−5 | 1.E−10 | .0150552 | | | | | | |
| [CO3=], Final | 2.209E−5 | 1.E−10 | .0080504 | .0080504 | .0080504 | | 1.181E−5 | 1.181−7 | 5.059E−4 |
| [H+] | .0000001 | 4.E−16 | 1.E−10 | 1.E−10 | 1.E−10 | 10 | .0000001 | .0000001 | .0000001 |
| [Cs+] | 3.18E−11 | | 3.18E−11 | 3.18E−11 | 3.18E−11 | | 3.18E−11 | 3.18E−13 | 1.363E−9 |
| [Ca+2], Init. | 4.479E−4 | 1.E−10 | 4.479E−4 | | | | | | |
| [Ca+2], Final | 4.479E−4 | 1.E−10 | 4.523E−7 | 4.523E−7 | 4.523E−7 | | 4.523E−7 | 4.523E−9 | 1.937E−5 |
| [Mg+2], Init. | | 1.E−10 | .0014263 | | | | | | |
| [Mg+2], Final | .0014263 | 1.E−10 | .0012000 | .0012000 | .0012000 | | .0012000 | 1.200E−5 | .0513932 |
| [Sr+2] | 5.35E−11 | | 5.35E−11 | 5.35E−11 | 5.35E−11 | | 5.35E−11 | 5.35E−13 | 2.291E−9 |
| Other Anions (Cl−, NO3−) | .0229222 | 25 | .0230220 | .0230220 | .0230220 | 10 | .0230221 | 2.302E−4 | .9859820 |
| Other Cations (Na+, NH4+) | 0 .0664203 | 25 | .0539238 | .0539238 | .0539238 | | .0378465 | 3.785E−4 | 1.620883 |
| Total Dissolved Inorganics (Normality) | .0701687 | 25.00000 | .0563247 | .0563247 | .0563247 | 10 | .0402475 | 4.026E−4 | 1.723708 |
| CHECK ANIONS | .0701688 | 25.00000 | .0563247 | .0563247 | .0563247 | 10 | .0402475 | 4.025E−4 | 1.723708 |
| TDS [Inorganics] (milligram/liter) | 5275 | 1000000 | 5279 | 5279 | 5279 | 365000 | 5278.630 | 52.78630 | 226071.5 |
| H2O (kg/hr) | 763.3296 | .0030503 | 763.3327 | 7.633327 | 755.6993 | 7.549E−6 | 755.6993 | 738.2266 | 17.47274 |
| CaSO4 (kg/hr) | 0 | | 0 | 0 | | | | | |
| CaCO3 (kg/hr) | 1.545442 | | 1.579594 | 1.579594 | | | | | |
| Mg(OH)2 (kg/hr) | | | .0100708 | .0100708 | | | | | |
| MgCO3 (kg/hr) | 0 | | 0 | 0 | | | | | |
| SrSO4 (kg/hr) | | | | | | | | | |
| Particulates (@ 1000 ppm) (kg/hr) | 3.16 | | 3.16 | 3.16 | | | | | |

FRED SEQUENCE FOR CASE 2 CONDITIONS
RESULTS FOR THE FREEZING PROCESS

FRED.FREEZE.VC1

Design Parameters for Processing PWR Inorganic Streams (Part 1; Freeze/Wash/Melt)

| | | | |
|---|---|---|---|
| Percent Feed Water to Slurry: | 99 | Percent Water Recovery: | 84.20 |
| Percent Slurry H2O as Brine: | 5 | Percent Water Delivered to ED System: | 14.80 |
| Percent Washed Ice H2O as Brine: | .5 | | |

TABLE 5-continued

Percent Melter H2O used as Wash: 10
Percent Ice melted and lost: 1

| POSITION | 1 | 2 | 3 | 4 | 5 | 6 | 7 | 8 |
|---|---|---|---|---|---|---|---|---|
| DISSOLVED INORGANIC CONCENTRATIONS | | | | | | | | |
| [SO4=] Init. | | 0 | | | | 0 | | |
| [SO4=] Final | 0 | 0 | 0 | 0 | 0 | 0 | 0 | 0 |
| [HCO3−] INITIAL | .0197 | .2469896 | | | | .0758434 | | |
| [HCO3−] FINAL | .0196908 | .2468740 | .2468740 | .0012344 | .0012344 | .0758079 | .0012344 | .0012344 |
| [CO3=] INITIAL | | 1.549E−4 | | | | 5.117E−5 | | |
| [CO3=] FINAL | 9.215E−6 | 1.155E−4 | 1.155E−4 | 5.777E−7 | 5.777E−7 | 2.548E−5 | 5.777E−7 | 5.777E−7 |
| [H+] | .0000001 | .0000001 | .0000001 | .0000001 | .0000001 | .0000001 | .0000001 | .0000001 |
| [Cs+] | 1.E−11 | 1.68E−10 | 1.68E−10 | 8.40E−13 | 8.40E−13 | 5.14E−11 | 8.40E−13 | 8.40E−13 |
| [Ca+2] Init. | | 8.563E−5 | | 0 | 0 | 2.789E−4 | 0 | 0 |
| [Ca+2] Final | .005 | 8.563E−5 | 8.563E−5 | 4.282E−7 | 4.282E−7 | 2.789E−4 | 4.282E−7 | 4.282E−7 |
| [Mg+2] | .0041 | .0689076 | .0689076 | 3.445E−4 | 3.445E−4 | .0023279 | 3.445E−4 | 3.445E−4 |
| [Sr+2] | 1.68E−11 | 2.82E−10 | 2.82E−10 | 1.41E−12 | 1.41E−12 | 8.64E−11 | 1.41E−12 | 1.41E−12 |
| Other Anions (Cl−, NO3−) | .0072 | .1210084 | .1210084 | 6.050E−4 | 6.050E−4 | .0370290 | 6.050E−4 | 6.050E−4 |
| Other Cations (Na+, NH4+) | .0087092 | 0 .2301271 | .2301271 | .0011506 | .0011506 | 0 .1076943 | .0011506 | .0011506 |
| Total Dissolved Inorganics (Normality) | .0269092 | .3681135 | .3681135 | .0018406 | .0018406 | .1129077 | .0018406 | .0018406 |
| CHECK ANIONS | .0269092 | .3681135 | .3681135 | | | .1129078 | | |
| TDS [Inorganics] (milligram/liter) | 1957 | 26333 | 26333 | 131.6642 | 132 | 8486 | 131.6642 | 131.6642 |
| H2O (kg/hr) | 3160 | 3128.4 | 31.6 | 295.6338 | 2956.338 | 467.6958 | 2956.338 | 2660.704 |
| CaSO4 (x, molality) | | | | | | | | |
| CaSO4 (kg/hr) | | 0 | | | | 0 | | |
| CaCO3 (kg/hr) | | 1.580562 | | | | 1.566573 | | |
| Mg(OH)2 (kg/hr) | | | | | | | | |
| MgCO3 (kg/hr) | | 0 | | | | 0 | | |
| SrSO4 (kg/hr) | | | | | | | | |
| Particulates (@ 1000 ppm) (kg/hr) | 3.16 | 3.16 | | | | 3.16 | | |

FRED SEQUENCE FOR CASE 2 CONDITIONS
RESULTS FOR THE ELECTRODIALYSIS PROCESS

FRED.ED.VC1
Design Parameters for Processing PWR Inorganic Streams (Part 2; Filter/ED)

| | | | |
|---|---|---|---|
| Settling Tank pH: | 10 | ED PLANT Percent Water Recovery: | 97.07 |
| ED Unit Feed pH: | 7 | CHEMICAL PLANT RECOVERY: | 99 |
| DECONTAMINATION FACTOR: | 100 | OVERALL WATER RECOVERY: | .9609481 |
| Percent Settler Blowdown: | 1 | | |

| POSITION | 6 | 9 | 10 | 11 | 12 | 13 | 14 | 15 | 16 |
|---|---|---|---|---|---|---|---|---|---|
| DISSOLVED | | | | | | | | | |

TABLE 5-continued

| INORGANIC CONCENTRATIONS | | | | | | | | | |
|---|---|---|---|---|---|---|---|---|---|
| [SO4=], Init. | 0 | | | | | | | | |
| [SO4=], Final | 0 | 1.E−10 | 4.00E−16 | 4.00E−16 | 4.00E−16 | | 4.00E−16 | 4.00E−18 | 1.35E−14 |
| | .0758434 | | .0406831 | | | | | | |
| [HCO3−] | .0758079 | 1.E−10 | .0277133 | .0277133 | .0277133 | | .0277133 | 2.771E−4 | .9350949 |
| [CO3=], Init. | 5.117E−5 | 1.E−10 | .0241790 | | | | | | |
| [CO3=], Final | 3.548E−5 | 1.E−10 | .0129698 | .0129698 | .0129698 | | 1.903E−5 | 1.903−7 | 6.421E−4 |
| [H+] | .0000001 | 4.E−16 | 1.E−10 | 1.E−10 | 1.E−10 | 10 | .0000001 | .0000001 | .0000001 |
| [Cs+] | 5.14E−11 | | 5.14E−11 | 5.14E−11 | 5.14E−11 | | 5.14E−11 | 5.14E−13 | 1.735E−9 |
| [Ca+2], Init. | 2.789E−4 | 1.E−10 | 2.789E−4 | | | | | | |
| [Ca+2], Final | 2.789E−4 | 1.E−10 | 2.800E−7 | 2.800E−7 | 2.800E−7 | | 2.800E−7 | 2.800E−9 | 9.446E−6 |
| [Mg+2], Init. | | 1.E−10 | .0023279 | | | | | | |
| [Mg+2], Final | .0023279 | 1.E−10 | .0012000 | .0012000 | .0012000 | | .0012000 | 1.200E−5 | .0404901 |
| [Sr+2] | 8.64E−11 | | 8.64E−11 | 8.64E−11 | 8.64E−11 | | 8.64E−11 | 8.64E−13 | 2.915E−9 |
| Other Anions (Cl−, NO3−) | .0370290 | 25 | .0371287 | .0371287 | .0371287 | 10 | .0371288 | 3.713E−4 | 1.252792 |
| Other Cations (Na+, NH4+) | 0 .1076943 | 25 | .088381 | .088381 | .088381 | | .0624795 | 6.248E−4 | 2.108179 |
| Total Dissolved Inorganics (Normality) | .1129077 | 25.00000 | .0907816 | .0907816 | .0907816 | 10 | .0648802 | 6.489E−4 | 2.189178 |
| CHECK ANIONS | .1129078 | 25.00000 | .0907816 | .0907816 | .0907816 | 10 | .0648802 | 6.488E−4 | 2.189171 |
| TDS [Inorganics] (milligram/liter) | 8486 | 1000000 | 8490 | 8490 | 8490 | 365000 | 8489.596 | 84.89596 | 286453.9 |
| H2O (kg/hr) | 467.6958 | .0018689 | 467.6977 | 4.676977 | 463.0207 | 4.626E−6 | 463.0207 | 449.4314 | 13.58929 |
| CaSO4 (kg/hr) | 0 | | 0 | 0 | | | | | |
| CaCO3 (kg/hr) | 1.566573 | | 1.579602 | 1.579602 | | | | | |
| Mg(OH)2 (kg/hr) | | | .0307534 | .0307534 | | | | | |
| MgCO3 (kg/hr) | 0 | | 0 | 0 | | | | | |
| SrSO4 (kg/hr) | | | | | | | | | |
| Particulates (@ 1000 ppm) (kg/hr) | 3.16 | | 3.16 | 3.16 | | | | | |

FRED SEQUENCE FOR CASE 3 CONDITIONS
RESULTS FOR THE FREEZING PROCESS

FRED.FREEZE.VC1

Design Parameters for Processing PWR Inorganic Streams (Part 1; Freeze/Wash/Melt)

| | | | |
|---|---|---|---|
| Percent Feed Water to Slurry: | 99 | Percent Water Recovery: | 59.00 |
| Percent Slurry H2O as Brine: | 25 | Percent Water Delivered to ED System: | 40.00 |
| Percent Washed Ice H2O as Brine: | .5 | | |
| Percent Melter H2O used as Wash: | 20 | | |
| Percent Ice melted and lost: | 1 | | |

| POSITION | 1 | 2 | 3 | 4 | 5 | 6 | 7 | 8 |
|---|---|---|---|---|---|---|---|---|
| DISSOLVED INORGANIC CONCENTRATIONS | | | | | | | | |
| [SO4=] Init. | | 0 | | | | 0 | | |
| [SO4=] Final | 0 | 0 | 0 | 0 | 0 | 0 | 0 | 0 |

TABLE 5-continued

| | | | | | | | | |
|---|---|---|---|---|---|---|---|---|
| [HCO3−] INITIAL | .0197 | .0574199 | | | | .0354804 | | |
| [HCO3−] FINAL | .0196908 | .0573931 | .0573931 | 2.870E−4 | 2.870E−4 | .0354638 | 2.870E−4 | 2.870E−4 |
| [CO3=] INITIAL | | 3.579E−5 | | | | 2.217E−5 | | |
| [CO3=] FINAL | 9.215E−6 | 2.686E−5 | 2.686E−5 | 1.343E−7 | 1.343E−7 | 1.660E−5 | 1.343E−7 | 1.343E−7 |
| [H+] | .0000001 | .0000001 | .0000001 | .0000001 | .0000001 | .0000001 | .0000001 | .0000001 |
| [Cs+] | 1.E−11 | 3.88E−11 | 3.88E−11 | 1.94E−13 | 1.94E−13 | 2.37E−11 | 1.94E−13 | 1.94E−13 |
| [Ca+2] Init. | | 3.683E−4 | | 0 | 0 | 5.961E−4 | 0 | 0 |
| [Ca+2] Final | .005 | 3.683E−4 | 3.683E−4 | 1.842E−6 | 1.842E−6 | 5.961E−4 | 1.842E−6 | 1.842E−6 |
| [Mg+2] | .0041 | .0159223 | .0159223 | 7.961E−5 | 7.961E−5 | 1.990E−4 | 7.961E−5 | 7.961E−5 |
| [Sr+2] | 1.68E−11 | 6.52E−11 | 6.52E−11 | 3.26E−13 | 3.26E−13 | 3.99E−11 | 3.26E−13 | 3.26E−13 |
| Other Anions (Cl−, NO3−) | .0072 | .0279612 | .0279612 | 1.398E−4 | 1.398E−4 | .0170965 | 1.398E−4 | 1.398E−4 |
| Other Cations (Na+, NH4+) | .0087092 | .0528267 | .0528267 | 2.641E−4 | 2.641E−4 | 0 .0510030 | 2.641E−4 | 2.641E−4 |
| Total Dissolved Inorganics (Normality) | .0269092 | .0854080 | .0854080 | 4.270E−4 | 4.270E−4 | .0525933 | 4.270E−4 | 4.270E−4 |
| CHECK ANIONS | .0269092 | .0854080 | .0854080 | 4.270E−4 | 4.270E−4 | .0525934 | 4.270E−4 | 4.270E−4 |
| TDS [Inorganics] (milligram/liter) | 1957 | 6112 | 6112 | 30.55933 | 31 | 3973 | 30.55935 | 30.55935 |
| H2O (kg/hr) | 3160 | 3128.4 | 31.6 | 466.1316 | 2330.658 | 1263.874 | 2330.658 | 1864.526 |
| CaSO4 (x, molality) | | | | | | | | |
| CaSO4 (kg/hr) | | 0 | | | | 0 | | |
| CaCO3 (kg/hr) | | 1.552214 | | | | 1.503153 | | |
| Mg(OH)2 (kg/hr) | | | | | | | | |
| MgCO3 (kg/hr) | | 0 | | | | 0 | | |
| SrSO4 (kg/hr) | | | | | | | | |
| Particulates (@ 1000 ppm) (kg/hr) | 3.16 | 3.16 | | | | 3.16 | | |

FRED SEQUENCE FOR CASE 3 CONDITIONS
RESULTS FOR THE ELECTRODIALYSIS PROCESS

FRED.ED.VC1

Design Parameters for Processing PWR Inorganic Streams (Part 2; Filter/ED)

| | | | |
|---|---|---|---|
| Settling Tank pH: | 10 | ED PLANT Percent Water Recovery: | 97.64 |
| ED Unit Feed pH: | 7 | CHEMICAL PLANT RECOVERY: | 99 |
| DECONTAMINATION FACTOR: | 100 | OVERALL WATER RECOVERY: | .9666675 |
| Percent Settler Blowdown: | 1 | | |

| POSITION | 6 | 9 | 10 | 11 | 12 | 13 | 14 | 15 | 16 |
|---|---|---|---|---|---|---|---|---|---|
| DISSOLVED INORGANIC CONCENTRATIONS | | | | | | | | | |
| [SO4=], Init. | 0 | | | | | | | | |
| [SO4=], Final | 0 | 1.E−10 | 4.00E−16 | 4.00E−16 | 4.00E−16 | | 4.00E−16 | 4.00E−18 | 1.68E−14 |
| | .0354804 | | .0197707 | | | | | | |
| [HCO3−] | .0354638 | 1.E−10 | .0134678 | .0134678 | .0134678 | | .0134678 | 1.347E−4 | .5657672 |
| [CO3=], Init. | 2.217E−5 | 1.E−10 | .0113112 | | | | | | |
| [CO3=], Final | 1.660E−5 | 1.E−10 | .0063029 | .0063029 | .0063029 | | 9.248E−6 | 9.248E−8 | 3.885E−4 |
| [H+] | .0000001 | 4.E−16 | 1.E−10 | 1.E−10 | 1.E−10 | 10 | .0000001 | .0000001 | .0000001 |

TABLE 5-continued

| | | | | | | | | | |
|---|---|---|---|---|---|---|---|---|---|
| [Cs+] | 2.37E−11 | | 2.37E−11 | 2.37E−11 | 2.37E−11 | | 2.37E−11 | 2.37E−13 | 9.98E−10 |
| [Ca+2], Init. | 5.961E−4 | 1.E−10 | 5.961E−4 | | | | | | |
| [Ca+2], Final | 5.961E−4 | 1.E−10 | 6.066E−7 | 6.066E−7 | 6.066E−7 | | 6.066E−7 | 6.066E−9 | 2.548E−5 |
| [Mg+2], Init. | | 1.E−10 | 1.990E−4 | | | | | | |
| [Mg+2], Final | 1.990E−4 | 1.E−10 | 1.990E−4 | 1.990E−4 | 1.990E−4 | | 1.990E−4 | 1.990E−6 | .0083618 |
| [Sr+2] | 3.99E−11 | | 3.99E−11 | 3.99E−11 | 3.99E−11 | | 3.99E−11 | 3.99E−13 | 1.676E−9 |
| Other Anions (Cl−, NO3−) | .0170965 | 25 | .0171963 | .0171963 | .0171963 | 10 | .0171964 | 1.720E−4 | .7224012 |
| Other Cations (Na+, NH4+) | 0 .0510030 | 25 | .0428706 | .0428706 | .0428706 | | .0302833 | 3.028E−4 | 1.272170 |
| Total Dissolved Inorganics (Normality) | .0525933 | 25.00000 | .0432699 | .0432699 | .0432699 | 10 | .0306827 | 3.069E−4 | 1.288945 |
| CHECK ANIONS | .0525934 | 25.00000 | .0432699 | .0432699 | .0432699 | 10 | .0306827 | 3.068E−4 | 1.288945 |
| TDS [Inorganics] (milligram/liter) | 3973 | 1000000 | 3977 | 3977 | 3977 | 365000 | 3976.943 | 39.76943 | 167067.0 |
| H2O (kg/hr) | 1263.874 | .0050505 | 1263.879 | 12.63879 | 1251.240 | 1.250E−5 | 1251.240 | 1221.746 | 29.49428 |
| CaSO4 (kg/hr) | 0 | | 0 | 0 | | | | | |
| CaCO3 (kg/hr) | 1.503153 | | 1.578416 | 1.578416 | | | | | |
| Mg(OH)2 (kg/hr) | | | 0 | 0 | | | | | |
| MgCO3 (kg/hr) | 0 | | 0 | 0 | | | | | |
| SrSO4 (kg/hr) | | | | | | | | | |
| Particulates (@ 1000 ppm) (kg/hr) | 3.16 | | 3.16 | 3.16 | | | | | |

FRED SEQUENCE FOR CASE 4 CONDITIONS
RESULTS FOR THE FREEZING PROCESS

FRED.FREEZE.VC1

Design Parameters for Processing PWR Inorganic Streams (Part 1; Freeze/Wash/Melt)

| | | | |
|---|---|---|---|
| Percent Feed Water to Slurry: | 99 | Percent Water Recovery: | 66.38 |
| Percent Slurry H2O as Brine: | 25 | Percent Water Delivered to ED System: | 32.62 |
| Percent Washed Ice H2O as Brine: | .5 | | |
| Percent Melter H2O used as Wash: | 10 | | |
| Percent Ice melted and lost: | 1 | | |

| POSITION | 1 | 2 | 3 | 4 | 5 | 6 | 7 | 8 |
|---|---|---|---|---|---|---|---|---|
| DISSOLVED INORGANIC CONCENTRATIONS | | | | | | | | |
| [SO4=] Init. | | 0 | | | | 0 | | |
| [SO4=] Final | 0 | 0 | 0 | 0 | 0 | 0 | 0 | 0 |
| [HCO3−] INITIAL | .0197 | .0574199 | | | | .0431967 | | |
| [HCO3−] FINAL | .0196908 | .0573931 | .0573931 | 2.870E−4 | 2.870E−4 | .0431765 | 2.870E−4 | 2.870E−4 |
| [CO3=] INITIAL | | 3.579E−5 | | | | 2.215E−5 | | |
| [CO3=] FINAL | 9.215E−6 | 2.686E−5 | 2.686E−5 | 1.343E−7 | 1.343E−7 | 2.021E−5 | 1.343E−7 | 1.343E−7 |
| [H+] | .0000001 | .0000001 | .0000001 | .0000001 | .0000001 | .0000001 | .0000001 | .0000001 |
| [Cs+] | 1.E−11 | 3.88E−11 | 3.88E−11 | 1.94E−13 | 1.94E−13 | 2.91E−11 | 1.94E−13 | 1.94E−13 |
| [Ca+2] Init. | | 3.683E−4 | | 0 | 0 | 4.896E−4 | 0 | 0 |
| [Ca+2] Final | .005 | 3.683E−4 | 3.683E−4 | 1.842E−6 | 1.842E−6 | 4.896E−4 | 1.842E−6 | 1.842E−6 |
| [Mg+2] | .0041 | .0159223 | .0159223 | 7.961E−5 | 7.961E−5 | 2.441E−4 | 7.961E−5 | 7.961E−5 |

TABLE 5-continued

| | | | | | | | | |
|---|---|---|---|---|---|---|---|---|
| [Sr+2] | 1.68E−11 | 6.52E−11 | 6.52E−11 | 3.26E−13 | 3.26E−13 | 4.88E−11 | 3.26E−13 | 3.26E−13 |
| Other Anions (Cl−, NO3−) | .0072 | .0279612 | .0279612 | 1.398E−4 | 1.398E−4 | .0209304 | 1.398E−4 | 1.398E−4 |
| Other Cations (Na+, NH4+) | .0087092 | .0528267 | .0528267 | 2.641E−4 | 2.641E−4 | 0 .0626798 | 2.641E−4 | 2.641E−4 |
| Total Dissolved Inorganics (Normality) | .0269092 | .0854080 | .0854080 | 4.270E−4 | 4.270E−4 | .0641472 | 4.270E−4 | 4.270E−4 |
| CHECK ANIONS | .0269092 | .0854080 | .0854080 | 4.270E−4 | 4.270E−4 | .0641473 | 4.270E−4 | 4.270E−4 |
| TDS [Inorganics] (milligram/liter) | 1957 | 6112 | 6112 | 30.55935 | 31 | 4845 | 30.55935 | 30.55935 |
| H2O (kg/hr) | 3160 | 3128.4 | 31.6 | 233.0658 | 2330.658 | 1030.808 | 2330.658 | 2097.592 |
| CaSO4 (x, molality) | | | | | | | | |
| CaSO4 (kg/hr) | | 0 | | | | 0 | | |
| CaCO3 (kg/hr) | | 1.552214 | | | | 1.527979 | | |
| Mg(OH)2 (kg/hr) | | | | | | | | |
| MgCO3 (kg/hr) | | 0 | | | | 0 | | |
| SrSO4 (kg/hr) | | | | | | | | |
| Particulates (@ 1000 ppm) (kg/hr) | 3.16 | 3.16 | | | | 3.16 | | |

FRED SEQUENCE FOR CASE 4 CONDITIONS
RESULTS FOR THE ELECTRODIALYSIS PROCESS

FRED.ED.VC1

Design Parameters for Processing PWR Inorganic Streams (Part 2; Filter/ED)

| | | | |
|---|---|---|---|
| Settling Tank pH: | 10 | ED PLANT Percent Water Recovery: | 97.64 |
| ED Unit Feed pH: | 7 | CHEMICAL PLANT RECOVERY: | 99 |
| DECONTAMINATION FACTOR: | 100 | OVERALL WATER RECOVERY: | .9666714 |
| Percent Settler Blowdown: | 1 | | |

| POSITION | 6 | 9 | 10 | 11 | 12 | 13 | 14 | 15 | 16 |
|---|---|---|---|---|---|---|---|---|---|
| DISSOLVED INORGANIC CONCENTRATIONS | | | | | | | | | |
| [SO4=], Init. | 0 | | | | | | | | |
| [SO4=], Final | 0 | 1.E−10 | 4.00E−16 | 4.00E−16 | 4.00E−16 | | 4.00E−16 | 4.00E−18 | 1.68E−14 |
| | .0431967 | | .0241970 | | | | | | |
| [HCO3−] | .0431765 | 1.E−10 | .0164829 | .0164829 | .0164829 | | .0164829 | 1.648E−4 | .6925450 |
| [CO3=], Init. | 2.715E−5 | 1.E−10 | .0137712 | | | | | | |
| [CO3=], Final | 2.021E−5 | 1.E−10 | .0077140 | .0077140 | .0077140 | | 1.132E−5 | 1.132E−7 | 4.756E−4 |
| [H+] | .0000001 | 4.E−16 | 1.E−10 | 1.E−10 | 1.E−10 | 10 | .0000001 | .0000001 | .0000001 |
| [Cs+] | 2.91E−11 | | 2.91E−11 | 2.91E−11 | 2.91E−11 | | 2.91E−11 | 2.91E−13 | 1.221E−9 |
| [Ca+2], Init. | 4.896E−4 | 1.E−10 | 4.896E−4 | | | | | | |
| [Ca+2], Final | 4.896E−4 | 1.E−10 | 4.955E−7 | 4.955E−7 | 4.955E−7 | | 4.955E−7 | 4.955E−9 | 2.082E−5 |
| [Mg+2], Init. | | 1.E−10 | 2.441E−4 | | | | | | |
| [Mg+2], Final | 2.441E−4 | 1.E−10 | 2.441E−4 | 2.441E−4 | 2.441E−4 | | 2.441E−4 | 2.441E−6 | .0102541 |
| [Sr+2] | 4.88E−11 | | 4.88E−11 | 4.88E−11 | 4.88E−11 | | 4.88E−11 | 4.88E−13 | 2.052E−9 |
| Other Anions (Cl−, NO3−) | .0209304 | 25 | .0210302 | .0210302 | .0210302 | 10 | .0210303 | 2.103E−4 | .8836051 |
| Other Cations | 0 | | | | | | | | |

TABLE 5-continued

| | | | | | | | | | |
|---|---|---|---|---|---|---|---|---|---|
| (Na+, NH4+) | .06268 | 25 | .052452 | .052452 | .052452 | | .0370466 | 3.705E−4 | 1.556551 |
| Total Dissolved Inorganics (Normality) | .0641473 | 25.00000 | .0529411 | .0529411 | .0529411 | 10 | .0375358 | 3.755E−4 | 1.577101 |
| CHECK ANIONS | .0641473 | 25.00000 | .0529411 | .0529411 | .0529411 | 10 | .0375358 | 3.754E−4 | 1.577101 |
| TDS [Inorganics] (milligram/liter) | 4845 | 1000000 | 4849 | 4849 | 4849 | 365000 | 4849.144 | 48.49144 | 203741.0 |
| H2O (kg/hr) | 1030.808 | .0041191 | 1030.812 | 10.30812 | 1020.504 | 1.019E−5 | 1020.504 | 996.4524 | 24.05137 |
| CaSO4 (kg/hr) | 0 | | 0 | 0 | | | | | |
| CaCO3 (kg/hr) | 1.527979 | | 1.578399 | 1.578399 | | | | | |
| Mg(OH)2 (kg/hr) | | | 0 | 0 | | | | | |
| MgCO3 (kg/hr) | 0 | | 0 | 0 | | | | | |
| SrSO4 (kg/hr) | | | | | | | | | |
| Particulates (@ 1000 ppm) (kg/hr) | 3.16 | | 3.16 | 3.16 | | | | | |

FRED SEQUENCE FOR CASE 5 CONDITIONS
RESULTS FOR THE FREEZING PROCESS

FRED.FREEZE.VC1

Design Parameters for Processing PWR Inorganic Streams (Part 1; Freeze/Wash/Melt)

| | | | |
|---|---|---|---|
| Percent Feed Water to Slurry: | 99 | Percent Water Recovery: | 39.20 |
| Percent Slurry H2O as Brine: | 50 | Percent Water Delivered to ED System: | 59.80 |
| Percent Washed Ice H2O as Brine: | .5 | | |
| Percent Melter H2O used as Wash: | 20 | | |
| Percent Ice melted and lost: | 1 | | |

| POSITION | 1 | 2 | 3 | 4 | 5 | 6 | 7 | 8 |
|---|---|---|---|---|---|---|---|---|
| DISSOLVED INORGANIC CONCENTRATIONS | | | | | | | | |
| [SO4=] Init. | | 0 | | | | 0 | | |
| [SO4=] Final | 0 | 0 | 0 | 0 | 0 | 0 | 0 | 0 |
| [HCO3−] INITIAL | .0197 | .0298004 | | | | .0248381 | | |
| [HCO3−] FINAL | .0196908 | .0297864 | .0297864 | 1.489E−4 | 1.489E−4 | .0248265 | 1.489E−4 | 1.489E−4 |
| [CO3=] INITIAL | | 1.825E−5 | | | | 1.513E−5 | | |
| [CO3=] FINAL | 9.215E−6 | 1.394E−5 | 1.394E−5 | 6.970E−8 | 6.970E−8 | 1.162E−5 | 6.970E−8 | 6.970E−8 |
| [H+] | .0000001 | .0000001 | .0000001 | .0000001 | .0000001 | .0000001 | .0000001 | .0000001 |
| [Cs+] | 1.E−11 | 1.98E−11 | 1.98E−11 | 9.90E−14 | 9.90E−14 | 1.63E−11 | 9.90E−14 | 9.90E−14 |
| [Ca+2] Init. | | 7.097E−4 | | 0 | 0 | 8.515E−4 | 0 | 0 |
| [Ca+2] Final | .005 | 7.097E−4 | 7.097E−4 | 3.549E−6 | 3.549E−6 | 8.515E−4 | 3.549E−6 | 3.549E−6 |
| [Mg+2] | .0041 | .0081188 | .0081188 | 4.059E−5 | 4.059E−5 | 4.789E−5 | 4.059E−5 | 4.059E−5 |
| [Sr+2] | 1.68E−11 | 3.33E−11 | 3.33E−11 | 1.66E−13 | 1.66E−13 | 2.74E−11 | 1.66E−13 | 1.66E−13 |
| Other Anions (Cl−, NO3−) | .0072 | .0142574 | .0142574 | 7.129E−5 | 7.129E−5 | .0117558 | 7.129E−5 | 7.129E−5 |
| Other Cations (Na+, NH4+) | .0087092 | .0264147 | .0264147 | 1.321E−4 | 1.321E−4 | 0 .0347666 | 1.321E−4 | 1.321E−4 |
| Total Dissolved Inorganics (Normality) | .0269092 | .0440718 | .0440718 | 2.204E−4 | 2.204E−4 | .0366054 | 2.204E−4 | 2.204E−4 |

TABLE 5-continued

| | | | | | | | | |
|---|---|---|---|---|---|---|---|---|
| CHECK ANIONS | .0269092 | .0440718 | .0440718 | 2.204E−4 | 2.204E−4 | .0366055 | 2.204E−4 | 2.204E−4 |
| TDS [Inorganics] (milligram/liter) | 1957 | 3157 | 3157 | 15.78581 | 16 | 2768 | 15.78581 | 15.78581 |
| H2O (kg/hr) | 3160 | 3128.4 | 31.6 | 309.7116 | 1548.558 | 1889.554 | 1548.558 | 1238.846 |
| CaSO4 (x, molality) | | | | | | | | |
| CaSO4 (kg/hr) | | 0 | | | | 0 | | |
| CaCO3 (kg/hr) | | 1.468967 | | | | 1.416419 | | |
| Mg(OH)2 (kg/hr) | | | | | | | | |
| MgCO3 (kg/hr) | | 0 | | | | 0 | | |
| SrSO4 (kg/hr) | | | | | | | | |
| Particulates (@ 1000 ppm) (kg/hr) | 3.16 | 3.16 | | | | 3.16 | | |

FRED SEQUENCE FOR CASE 5 CONDITIONS
RESULTS FOR THE ELECTRODIALYSIS PROCESS

FRED.ED.VC1
Design Parameters for Processing PWR Inorganic Streams (Part 2; Filter/ED)

| | | | |
|---|---|---|---|
| Settling Tank pH: | 10 | ED PLANT Percent Water Recovery: | 97.64 |
| ED Unit Feed pH: | 7 | CHEMICAL PLANT RECOVERY: | 99 |
| DECONTAMINATION FACTOR: | 100 | OVERALL WATER RECOVERY: | .9666020 |
| Percent Settler Blowdown: | 1 | | |

| POSITION | 6 | 9 | 10 | 11 | 12 | 13 | 14 | 15 | 16 |
|---|---|---|---|---|---|---|---|---|---|
| DISSOLVED INORGANIC CONCENTRATIONS | | | | | | | | | |
| [SO4=], Init. | 0 | | | | | | | | |
| [SO4=], Final | 0 | 1.E−10 | 4.00E−16 | 4.00E−16 | 4.00E−16 | | 4.00E−16 | 4.00E−18 | 1.67E−14 |
| | .0248381 | | .0136713 | | | | | | |
| [HCO3−] | .0248265 | 1.E−10 | .0093129 | .0093129 | .0093129 | | .0093129 | 9.313E−5 | .3901288 |
| [CO3=], Init. | 1.513E−5 | 1.E−10 | .0079184 | | | | | | |
| [CO3=], Final | 1.162E−5 | 1.E−10 | .0043584 | .0043584 | .0043584 | | 6.395E−6 | 6.395E−8 | 2.679E−4 |
| [H+] | .0000001 | 4.E−16 | 1.E−10 | 1.E−10 | 1.E−10 | 10 | .0000001 | .0000001 | .0000001 |
| [Cs+] | 1.63E−11 | | 1.63E−11 | 1.63E−11 | 1.63E−11 | | 1.63E−11 | 1.63E−13 | 6.84E−10 |
| [Ca+2], Init. | 8.515E−4 | 1.E−10 | 8.515E−4 | | | | | | |
| [Ca+2], Final | 8.515E−4 | 1.E−10 | 8.821E−7 | 8.821E−7 | 8.821E−7 | | 8.821E−7 | 8.821E−9 | 3.695E−5 |
| [Mg+2], Init. | | 1.E−10 | 6.789E−5 | | | | | | |
| [Mg+2], Final | 6.789E−5 | 1.E−10 | 6.789E−5 | 6.789E−5 | 6.789E−5 | | 6.789E−5 | 6.789E−7 | .0028439 |
| [Sr+2] | 2.74E−11 | | 2.74E−11 | 2.74E−11 | 2.74E−11 | | 2.74E−11 | 2.74E−13 | 1.149E−9 |
| Other Anions (Cl−, NO3−) | .0117558 | 25 | .0118556 | .0118556 | .0118556 | 10 | .0118557 | 1.186E−4 | .4966506 |
| Other Cations (Na+, NH4+) | 0 | | | | | | | | |
| | .0347666 | 25 | .0297479 | .0297479 | .0297479 | | .0210438 | 2.104E−4 | .8815533 |
| Total Dissolved Inorganics (Normality) | .0366054 | 25.00000 | .0298854 | .0298854 | .0298854 | 10 | .0211814 | 2.119E−4 | .8873151 |
| CHECK ANIONS | .0366055 | 25.00000 | .0298854 | .0298854 | .0298854 | 10 | .0211814 | 2.118E−4 | .8873151 |
| TDS [Inorganics] (milligram/liter) | 2768 | 1000000 | 2772 | 2772 | 2772 | 365000 | 2771.773 | 27.71773 | 116112.9 |

TABLE 5-continued

| | | | | | | | | | |
|---|---|---|---|---|---|---|---|---|---|
| H2O (kg/hr) | 1889.554 | .0075507 | 1889.561 | 18.89561 | 1870.666 | 1.869E−5 | 1870.666 | 1826.446 | 44.21932 |
| CaSO4 (kg/hr) | 0 | | 0 | 0 | | | | | |
| CaCO3 (kg/hr) | 1.416419 | | 1.577151 | 1.577151 | | | | | |
| Mg(OH)2 (kg/hr) | | | 0 | 0 | | | | | |
| MgCO3 (kg/hr) | 0 | | 0 | 0 | | | | | |
| SrSO4 (kg/hr) | | | | | | | | | |
| Particulates (@ 1000 ppm) (kg/hr) | 3.16 | | 3.16 | 3.16 | | | | | |

TABLE 6

| Scenario # | Sequences | Slurry Brine % | Wash Water % |
|---|---|---|---|
| 1 | FRED | 5 | 20 |
| 2 | FRED | 5 | 10 |
| 3 | FRED | 25 | 20 |
| 4 | FRED | 25 | 10 |
| 5 | FRED | 50 | 20 |
| 6 | FRED | 50 | 10 |
| 7 | EDFRA | 5 | 20 |
| 8 | EDFRA | 5 | 10 |
| 9 | EDFRA | 25 | 20 |
| 10 | EDFRA | 25 | 10 |
| 11 | EDFRA | 50 | 20 |
| 12 | EDFRA | 50 | 10 |

*FRED: Freezing followed by ED
EDFRA: ED followed by freezing
brine cover: slurry water used as brine
wash water: water from melter used to wash the ice not operate with significant solids present in the stream. The pH of the streams outside the chemical treatment section is held constant at 7 (by the limited addition of HCL or NaOH).

In washing the ice, the brine solution containing the ice crystals will not be completely removed. The simulation assumes that at a half of a percent (0.5%) of the water leaving the washer is brine. This residual brine determines the salt content of the decontaminated product water leaving the freezing process.

It is also assumed in the washing step that one percent (1%) of the ice is melted. This water is lost to the wash water.

The ED process is designed for a 100-fold reduction of the feed stream salinity in the simulation. Higher reductions are possible with ED. ED plants have been designed for reductions as high as 20,000 fold.

RESULTS OF THE COMPUTER MODEL

In total, twelve cases have been analyzed with the simulator model. Six of the freezing process first (FRED) as shown in Table 5 and 6 for the chemical treatment and the ED first (EDFRA). The scenarios are listed in Table 5 and the case numbers for each set of six are summarized in Table 6 relative to the values of:

* the percent melter water used as wash water, and
* the percent slurry water used as brine.

The results of the analysis are given in Table 5. The results are divided into two parts corresponding to the two sequences for the processes. The performance of the combined process is given both in terms of the level of decontamination achieved and in terms of the concentration of radioactivity. The volume fractions of water indicate how the feed stream is divided between the decontaminated stream and the concentrated The basic assumptions are:

* The inorganic chemical waste stream was used as basis for the evaluation (Table 6).
* the 1.4% sodium sulfate produced by the IX processes has been dropped out from the stream analysis, assuming that FREDCON shall replace all the existing LWMS in the plant under consideration.
* pH 10 of chemical precipitates is used.
* 0.5% washed ice water is assumed as brine. The freezing unit suppliers claim that this fraction can be maintained at nearly 0.0%.
* 1% ice melted and lost to wash.
* 99% feed water converted to ice slurry.
* 1.0% blowdown of chemical precipitation is used.

From the results shown in Table 7:

* A high concentration factor (CF) of radioactive material (or large VR) is achieved in both system at the expense of achieving a high decontamination factor (DF). Namely the DF increased monotonically as the percent of the slurry water as brine increases while the concentration factor decreases monotonically.
* The magnitude of the DF is dependent upon the amount of residual brine on the ice after washing.
* At lower levels; less than 0.5%, a higher DF will be achieved.
* If a lower level of brine can be obtained from the washing step, a second ED can be added to further decontaminate the product water from the freezer system. This ED step can be added into either FRED or EDFRA arrangement.
* The difference between both arrangements does not clearly favor one over the other in terms of the CF or DF analyses. This is especially because of the conservative assumptions related to freezing. Using suppliers' number can entirely reverse the situation.

FRED may be favored over EDFRA due to the ability of the first arrangement to consolidate solids up to 41% in the blowdown from the chemical treatment section. This is while the second sequence is limited to @7% precipitation. This observation came out from a detailed analysis with the results shown in Table 3.

* The higher solid content in the blowdown is of significant potential, since these solids while in themselves are not necessarily radioactive, will carry with them some radioactive materials. The blowdown will therefore require special handling and disposal.

TABLE 7

| Process Sequence | Scenario # | DECONTAMINATION DF | DECONTAMINATION VOLUME FRACTION | CONCENTRATION OF RADIOACTIVITY CF | CONCENTRATION OF RADIOACTIVITY VOLUME FRACTION |
|---|---|---|---|---|---|
| Primary freezing | 1 | 17.3 | 0.9821 | 58.6 | 0.0179 |
| process with | 2 | 15.7 | 0.9842 | 68.1 | 0.0158 |
| chemical precipi- | 3 | 57.2 | 0.9767 | 46.7 | 0.0233 |
| tation of wash water | 4 | 53.8 | 0.9791 | 52.0 | 0.0209 |
| and subsequent | 5 | 85.5 | 0.9700 | 37.0 | 0.0300 |
| treatment by ED | 6 | 82.9 | 0.9717 | 39.0 | 0.0283 |
| Pretreatment by | 7 | 25.6 | 0.9843 | 51.0 | 0.0157 |
| chemical precipita- | 8 | 23.4 | 0.9866 | 58.1 | 0.0134 |
| tion and primary ED | 9 | 66.3 | 0.9806 | 44.7 | 0.0194 |
| process with brine | 10 | 63.7 | 0.9823 | 48.8 | 0.0177 |
| concentration by | 11 | 85.5 | 0.9759 | 36.5 | 0.0241 |
| subsequent freezing treatment | 12 | 84.0 | 0.9771 | 38.4 | 0.0229 |

These results of Phase I suggest that the preferred sequence is to place the freezing process first (FRED) and then to treat the wash water (and possibly the product water) with ED. At least in the case of the wash water, the water should be pretreated by chemical means before it is processed by the ED section. This sequence is the sequence proposed for the pilot plant to be tested in Phase II.

According to these observations, it is necessary to include in the test plan for Phase II the following items:

* Verification of the fraction of contaminated water that remains covering the ice after wash.
* Optimization of the design for maximum VR within the constraints of a fixed high DF (regulatory limits).

The computer printouts for the process sequence where the freezing process is first are given in Table 5a through Table 5f for cases one through six, respectively. In this sense, the "a" labels are for the freezing process and the "b" labels are for the electrodialysis process.

The computer printouts for the process sequence where the electrodialysis (and filtration) process is first are given in Table 5g through Table 51 for the cases one through six, respectively. In this series, the electrodialysis results are given in Table 5g and, since they are the same for the other five cases, they are omitted. The freezing results are however, different so the full "b" series of figures are given.

ANALYSIS OF THE RESULTS

A summary of the decontaminated (DF) and concentration (CF) factors for the twelve cases is given in Table 7. The six cases in the upper half of Table 7 are for the process sequence where the freezing process is first. The six cases in the lower half are for the process sequence where the electrodialysis process is first. In each half, the cases are in order, i.e. starting with case one and ending with case six.

Inspection of the results in Table 7 indicates an inverse correlation between the DF and CF for both sequences where the DF comes approximately as the inverse cube of the CF. That is, if one designs the process to achieve a high CF (volume reduction) then the degree of decontamination of the decontaminated product water is reduced. To a large extent, this correlation is due to the assumed inefficiency of the washing step in the freezing process. In particular, it is "assumed that" the ice slurry leaves the washing step with 5 percent of the water as brine coating the ice. If the washing step is actually more efficient than this, then correlation can be broken or at least minimized and both high values of CF and DV can be achieved simultaneously.

If the efficiency of the washing step can not be improved from the assumed level, then it may be necessary to treat the product water from the freezer process by electrodialysis and thereby increase the DF for a given CF. In this case, separate ED steps would probably be used for the product and wash waters since the wash water is first treated by the chemical precipitation and clarification step.

In general, the results for DF and CF in Table 7, do not favor either process sequence. If the efficiency of the washing step is as assumed, then the process sheet with a second ED step is probably more straight forward with the freezing process as the first process.

An additional criterion for selecting the preferred sequence is the solids content which can be achieved in the blowdown from th chemical precipitation step. These results are summarized in Table 3 for the twelve cases. The organization of the results in Table 3 is identical with the organization in Table 7 in that the results for the freezing first process are in the upper half and cases are sequential starting with case one at the top of each half.

Note in particular, that with the ED process first, the solids content is limited to about 7 percent, assuming a one percent blowdown for the clarification (filtration or other process) step, for all six cases. This occurs because with the ED process first, the process, always sees the same feed and the results are not influenced by alterations in the freezing process.

In all six cases where the freezing process is first, the total solids content in the flowdown exceeds 7 percent. The solids content also increases as expected with increasing values of CF (see Table 7 for CF's). While in practice, it may not be possible to achieve the highest concentrations of solids irradiated in Table 3, the potential for high solids content in the blowdown suggests that the process sequence should be the sequence with the freezing process first.

SUMMARY AND CONCLUSION

The major conclusions of the study of alternative process sequences and preferred operating conditions are:

(1) the freezing process should be the first process in the sequence, and (2) the efficiency of the washing step in the freezing process, in general, determines the level of decontamination of the product water.

Both conclusions are subject to experimental test since they ultimately are only as good as the assumptions used in developing the simulated results with the computer model.

With regard to the first conclusion, the selection of the freezing process as the first process is based on the higher solids content attainable in the blowdown from the chemical precipitation and clarification step. The critical assumption is that the blowdown in either process sequence requires one percent of the water in the feed to this step. If, for example, lower percentage can be used with the electrodialysis process as the first process, then this conclusion could be reversed.

With regard to the second conclusion, the efficiency of the washing step is less significant in determining the level of decontamination if the process is modified such that the product water from the freezing process is further treated by a second electrodialysis step. In the latter case or in the case that the efficiency of the washing step is better than assumed (washed ice slurry leaves the washer with 0.5 percent of the water as brine coating the ice), both high values of decontamination and concentration can be achieved simultaneously.

While preferred embodiments have been shown and described, it will be understood that the present invention is not limited thereto, but may be otherwise embodied within the scope of the present invention.

What is claimed is:

1. A nuclear plant low level liquid radioactive waste treatment and volume reduction process comprising the steps of:

collecting the low-level liquid radioactive wastes influent within the plant into a holding tank for processing;

directing a first waste-containing stream containing the low-level liquid radioactive wastes at a regulated flow rate from the holding tank to a plate precooler wherein the first waste-containing stream is chilled to near its freezing point;

introducing the chilled waste-containing stream into a freezing crystallizer to form ice crystals from the water in the stream and to obtain a waste stream containing residual salts and having a reduced volume relative to the first waste-containing stream;

recirculating the reduced volume stream into a recirculation loop around the crystallizer to maintain proper velocity and uniformity of ice fraction in the crystallizer;

increasing the formation rate of ice until the concentration of the residual salts in the recirculating waste-containing stream becomes high enough to precipitate some of the salts as wet salts;

directing the wet salts and any other solid contaminants to a disposal tank for eventual packaging in standard radioactive waste forms for shipment to disposal sites;

separating the ice crystals and washing the ice to remove adhering waste liquid, melting the ice, and then recycling or disposing the melted ice as a purified liquid;

collecting the reduced volume stream after separating the wet salts of ice to form a second waste-containing stream which includes the waste liquid removed from the ice;

electrodialyzing the second waste containing stream to further reduce the volume of the second waste-containing stream and thereby produce a third stream concentrated with inactive ions and other waste ions; and then recycling the third waste stream through the precooling and crystallizing freezing steps.

2. A process as claimed in claim 1, further comprising:

adding of sodium hydroxide to the second waste-containing stream produced by the freezing steps prior to the electrodialysis step to form precipitates;

filtering the second waste stream to separate precipitates;

directing the precipitates to a disposal tank for eventual packaging in standard radioactive waste forms for shipment to disposal sites; and then adding hydrochloric acid to the filtrate of the second waste stream to adjust the pH of the second waste stream.

3. A process as claimed in claim 1, wherein said freezing is a eutectic, bulk, indirect crystallization process comprising introducing the precooled first waste-containing stream into the tube side of a shell and tube evaporator with a recirculation loop; and evaporating ammonia on the shell side to remove heat through the tube wall, thus freezing a portion of the stream.

4. A process as claimed in claim 1, comprising the step of separating the water ice crystals from the reduced volume waste stream by consolidating and propelling the ice on the top of a wash column by hydraulic piston action while allowing water to enter over the top surfaces of the wash column at atmospheric pressure and fall down by gravity to wash away the liquid waste adhering to the water ice crystals.

5. A process as claimed in claim 1, wherein the waste-containing stream contains low-level liquid radioactive wastes of variable composition comprising high/low conductivity waste; chemical waste; laundry/detergent wastes; or stream generator blowdown.

6. A waste treatment process comprising the steps of freezing an aqueous, radioactive waste-containing stream to form (a) a brine containing at least a portion of the waste, and (b) a slurry containing ice and the remainder of the waste;

removing a portion of the slurry containing at least some of the remainder of the waste;

washing the ice to remove therefrom a further portion of the waste as an aqueous solution thereof; and electrodialyzing the aqueous solution and the brine to remove at least said further portion of the waste as a further concentrated brine.

7. A process as in claim 6 wherein said radioactive waste-containing stream is produced within a nuclear plant and where the process occurs in the plant; said plant is a boiling water reactor, a pressurized water reactor or a nuclear facility.

8. A process as in claim 6 including melting the washed ice to provide a first stream of decontaminated water for disposal to the environment.

9. A process as in claim 8 including reusing a portion of the first stream of the decontaminated water as the water used in said washing step to reduce adding fresh water.

10. A process as in claim 6 where said electrodialyzing step forms a second stream of decontaminated water for disposal to the environment.

11. A process as in claim 6 including filtering any particulate matter from said brine and adding NaOH to said brine to precipitate salts from said brine and adjusting the pH of acid brine prior to electrodialyzing.

12. A process as claimed in claim 10 wherein decontaminated water is recycled in the plant.

13. A process as claimed in claim 8 wherein decontaminated water is recycled in the plant.

14. A process as claimed in claim 6 wherein said brine from electrodialyzing is further processed by the freezing stage to produce wet salts.

15. A process as claimed in claim 8 wherein said decontaminated water is not potable water.

16. A process as claimed in claim 10 wherein said decontaminated water is not potable water.

17. A process as claimed in claim 6 wherein said waste is radioactive inorganic chemical waste and detergent.

18. A process for continuous concentration of aqueous waste stream containing wastes of unknown composition that may vary in concentration over short periods of time comprising the steps of:

freezing the aqueous waste stream to extract water as ice crystals leaving a secondary aqueous waste stream and a slurry of wet solid particulates;

settling and filtering the secondary aqueous waste stream to remove particulates in a tank;

adding sodium hydroxide to collecting the aqueous waste stream in said tank to form a third waste stream;

adjusting the pH of the third stream;

electrodialyzing the third stream to produce a fourth waste stream with high concentration of salts;

recycling the fourth stream by the freezing step until all wastes are transformed into a slurry of wet solid particulates; and disposing of the slurry of wastes.

19. A process as claimed in claim 18 wherein the ice crystals are melted and discharged to the environment as water.

* * * * *